US006808015B2

(12) United States Patent
Osakabe

(10) Patent No.: US 6,808,015 B2
(45) Date of Patent: Oct. 26, 2004

(54) BOILING COOLER FOR COOLING HEATING ELEMENT BY HEAT TRANSFER WITH BOILING

(75) Inventor: Hiroyuki Osakabe, Chita-gun (JP)

(73) Assignee: DENSO Corporation, Kariya (JP)

( * ) Notice: Subject to any disclaimer, the term of this patent is extended or adjusted under 35 U.S.C. 154(b) by 105 days.

(21) Appl. No.: 09/813,606

(22) Filed: Mar. 21, 2001

(65) Prior Publication Data

US 2001/0023758 A1 Sep. 27, 2001

(30) Foreign Application Priority Data

| | | |
|---|---|---|
| Mar. 24, 2000 | (JP) | 2000-083918 |
| Jul. 14, 2000 | (JP) | 2000-214152 |
| Jul. 14, 2000 | (JP) | 2000-214204 |
| Jul. 14, 2000 | (JP) | 2000-214333 |
| Jul. 14, 2000 | (JP) | 2000-214449 |

(51) Int. Cl.[7] ..... F28D 15/00

(52) U.S. Cl. ..... 165/104.25; 165/41; 165/104.21; 165/104.33; 165/143; 165/144; 361/700; 257/715

(58) Field of Search ..... 165/41, 104.21, 165/104.25, 104.33, 143, 144; 361/700; 257/715

(56) References Cited

U.S. PATENT DOCUMENTS

| | | | | | |
|---|---|---|---|---|---|
| 3,621,908 | A | * | 11/1971 | Pravda | 165/86 |
| 4,127,105 | A | * | 11/1978 | Watt | 126/271 |
| 4,640,347 | A | * | 2/1987 | Grover et al. | 165/104.26 |
| 5,421,169 | A | * | 6/1995 | Benedict | 62/244 |
| 5,899,265 | A | * | 5/1999 | Schneider et al. | 165/104.33 |
| 5,983,652 | A | * | 11/1999 | Iritani et al. | 62/156 |
| 6,016,966 | A | * | 1/2000 | Inoue | 236/37 |
| 6,073,683 | A | * | 6/2000 | Osakabe et al. | 165/104.33 |
| 6,076,596 | A | * | 6/2000 | Osakabe et al. | 165/104.33 |
| 6,167,948 | B1 | * | 1/2001 | Thomas | 165/104.26 |
| 6,263,046 | B1 | * | 7/2001 | Rogers | 378/141 |
| 6,269,865 | B1 | * | 8/2001 | Huang | 165/104.26 |
| 6,321,831 | B1 | * | 11/2001 | Tanaka et al. | 165/104.33 |
| 6,341,646 | B1 | * | 1/2002 | Tanaka et al. | 165/104.33 |
| 6,357,517 | B1 | * | 3/2002 | Osakabe et al. | 165/104.33 |
| 6,360,814 | B1 | * | 3/2002 | Tanaka et al. | 165/104.33 |
| 6,474,074 | B2 | * | 11/2002 | Ghoshal | 62/3.7 |
| 6,487,076 | B1 | * | 11/2002 | Wang | 361/697 |
| 6,527,045 | B1 | * | 3/2003 | Osakabe et al. | 165/104.33 |
| 6,625,024 | B2 | * | 9/2003 | Mermet-Guyennet | 361/700 |
| 6,681,843 | B2 | * | 1/2004 | Sugito | 165/104.33 |

FOREIGN PATENT DOCUMENTS

| | | | | |
|---|---|---|---|---|
| JP | A-8-204075 | | 8/1996 | |
| JP | A-9-126617 | | 5/1997 | |
| JP | 02000022377 | A * | 1/2000 | H05K/7/20 |

* cited by examiner

*Primary Examiner*—Cheryl J. Tyler
*Assistant Examiner*—Nihir Patel
(74) *Attorney, Agent, or Firm*—Harness, Dickey & Pierce, PLC

(57) ABSTRACT

A boiling cooler has a heat exchange part in which refrigerant vapor performs heat exchange with cooling water. The refrigerant vapor is produced from liquid refrigerant that is boiled and gasified by heat transferred from a heating element. In this boiling cooler, the refrigerant vapor can be cooled by cooling water having a thermal conductivity larger than that of air.

25 Claims, 32 Drawing Sheets

FIG. 21
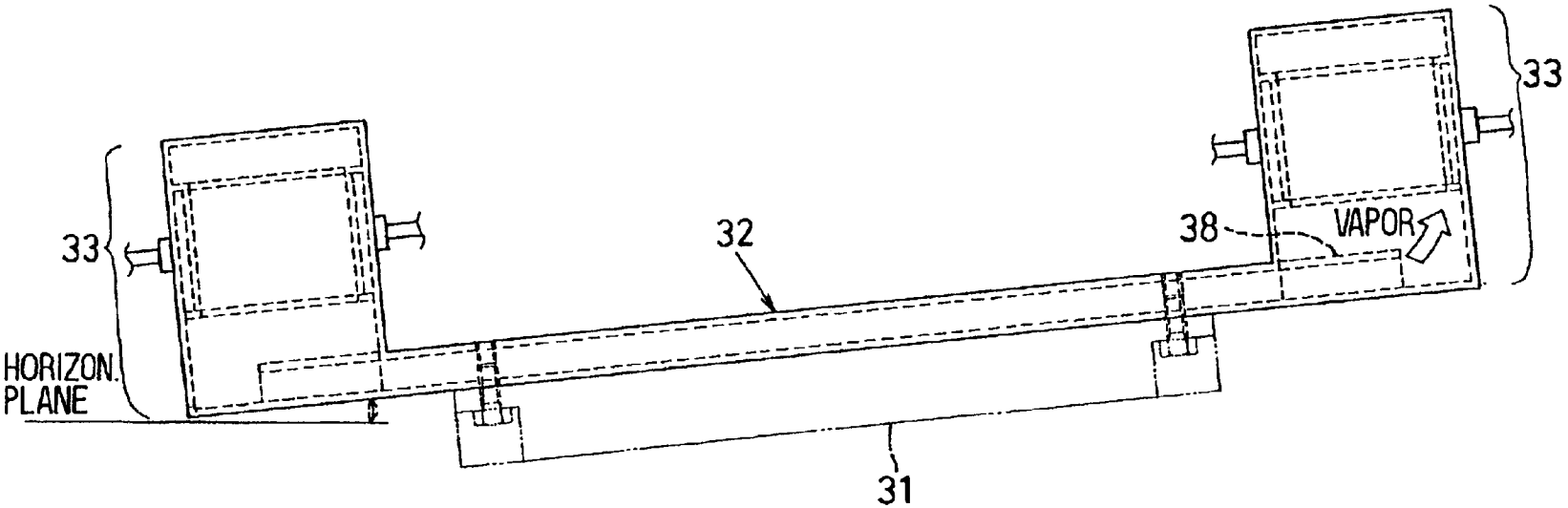
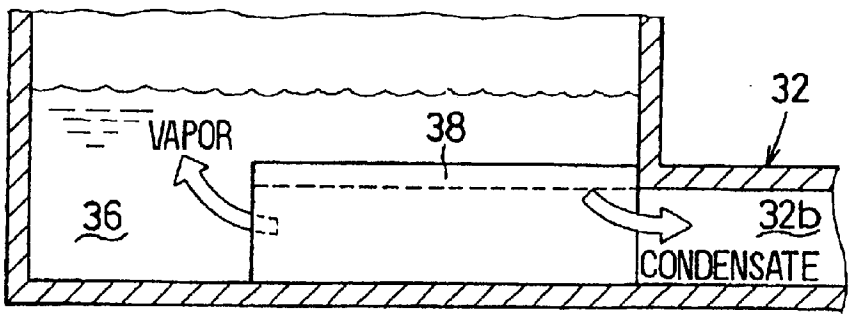
FIG. 22

BOILING COOLER FOR COOLING HEATING ELEMENT BY HEAT TRANSFER WITH BOILING

CROSS REFERENCE TO RELATED APPLICATIONS

This application is based upon and claims the benefit of Japanese Patent Applications No. 2000-83918 filed on Mar. 24, 2000, No. 2000-214152 filed on Jul. 14, 2000, No. 2000-214204 filed on Jul. 14, 2000, No. 2000-214333 filed on Jul. 14, 2000, and No. 2000-214449 filed on Jul. 14, 2000, the contents of which are incorporated herein by reference.

BACKGROUND OF THE INVENTION

1. Field of the Invention

This invention relates to a boiling cooler for cooling a heating element by heat transfer with boiling.

2. Description of the Related Art

JP-A-8-204075 discloses a boiling cooler that cools a heating element by heat transfer with boiling of refrigerant. This boiling cooler can provide a high thermal conductivity in comparison with air-cooling and water-cooling methods. Therefore, it is widely used as a cooler for a semiconductor device that generates a large heat flux. This boiling cooler is composed of a refrigerant tank for storing liquid refrigerant, a radiator for cooling vapor of refrigerant that is boiled in the refrigerant tank by heat generated from the heating element, and a cooling fan for supplying cooling air to the radiator.

In the conventional boiling cooler, however, while condensation heat transfer is performed with a large thermal conductivity at the inside of the radiator, cooling with air is performed with a smaller thermal conductivity at the outside of the radiator. Therefore, the size of the radiator must be increased to comply with the necessity for the cooling with air. As a result, the installation of the boiling cooler is liable to be limited. Especially when the boiling cooler is mounted on a vehicle or the like, its mountability is very low because it must be disposed in a narrow space.

SUMMARY OF THE INVENTION

The present invention has been made in view of the above problems. An object of the present invention is to provide a boiling cooler having good mountability.

According to the present invention, briefly, a boiling cooler has a heat exchange part in which refrigerant vapor performs heat exchange with liquid. The refrigerant vapor is produced from liquid refrigerant that is boiled and gasified by heat transferred from a heating element. In this boiling cooler, the refrigerant vapor can be cooled by the liquid (for example, water) having a thermal conductivity larger than that of air. Therefore, unlike the conventional cooler, a large-sized radiator is not required, and as a result, the size reduction of the boiling cooler can be realized, resulting in good mountability to a vehicle.

BRIEF DESCRIPTION OF THE DRAWINGS

Other objects and features of the present invention will become more readily apparent from a better understanding of the preferred embodiments described below with reference to the following drawings, in which;

FIG. 21 is a front view showing the boiling cooler with the refrigerant vessel that is inclined, in the sixth embodiment;

FIG. 22 is a cross-sectional view taken along line XXII—XXII in FIG. 18;

DETAILED DESCRIPTION OF THE PREFERRED EMBODIMENTS

First Embodiment

Figure 4:
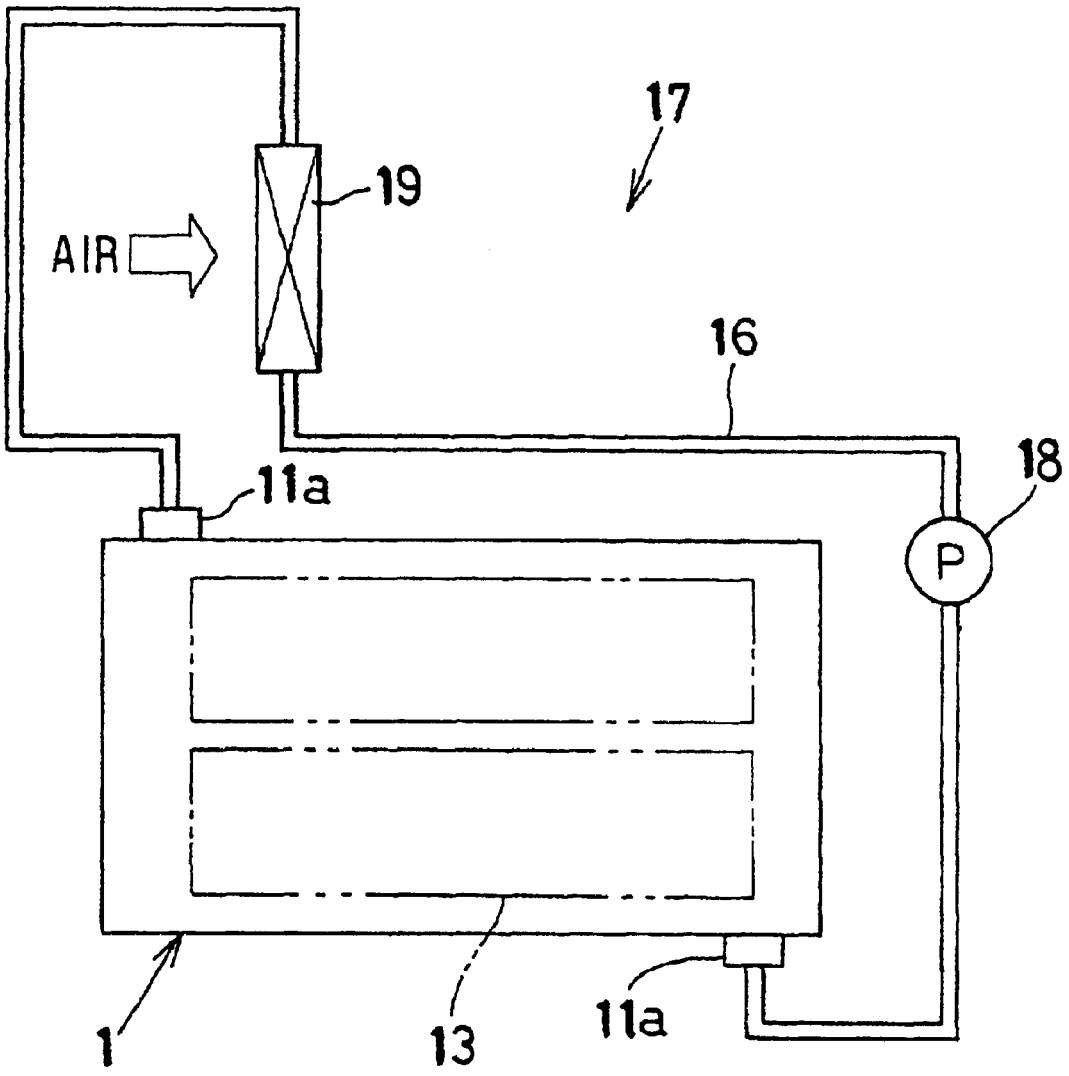
FIG. 4 is a diagram showing an entire constitution of a cooling system in the first embodiment.

A boiling cooler in a first embodiment of the invention, an entire cooling system of which is shown in FIG. 4, has a box-shaped thermal diffusion block 1 enclosing refrigerant therein.

Figure 1A:
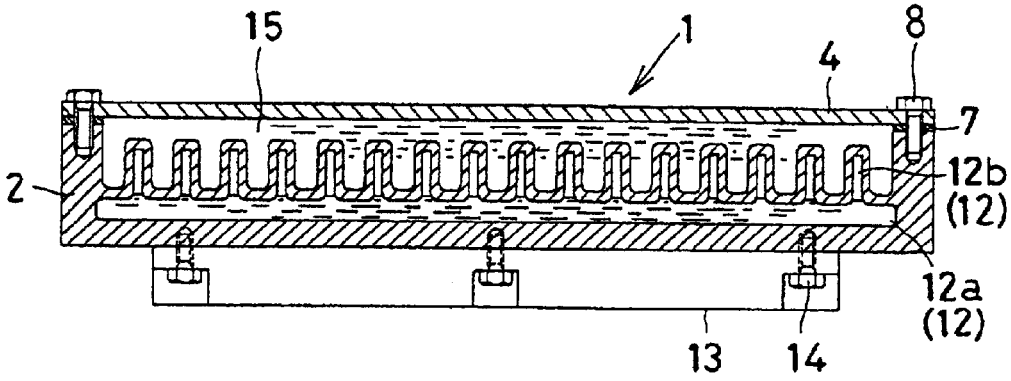
FIG. 1A is a cross-sectional view showing a thermal diffusion block, taken along line IA—IA in FIG. 1B, according to a first embodiment of the invention.
Figure 1B:
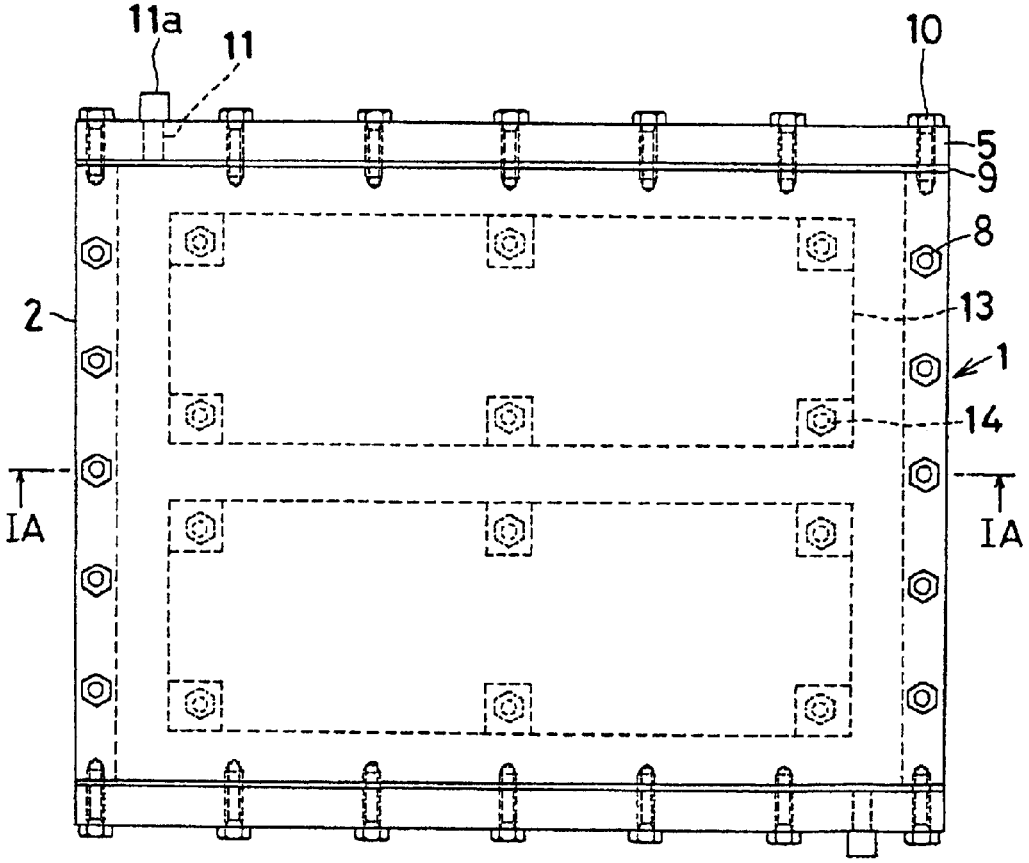
FIG. 1B is a plan view showing the thermal diffusion block in the first embodiment.
Figure 2A:
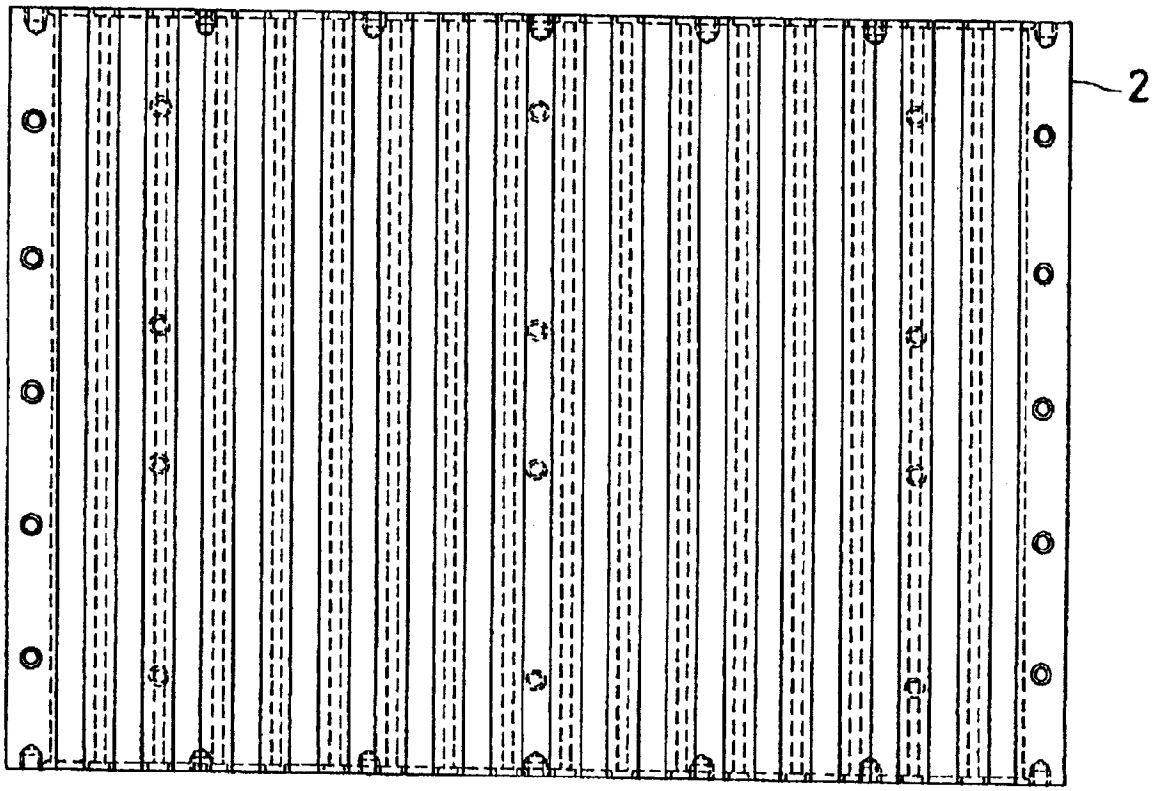
FIG. 2A is a plan view showing a block body in the first embodiment.
Figure 2B:
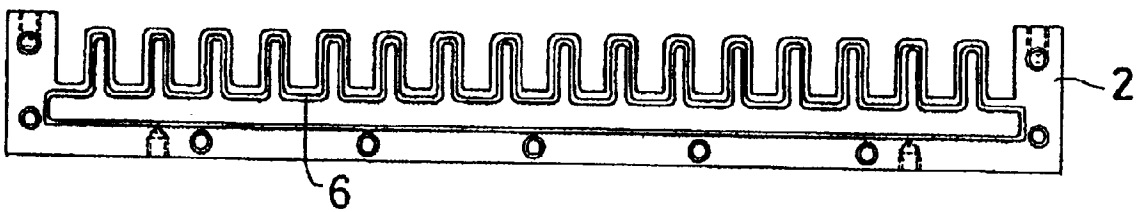
FIG. 2B is a side view of the block body.
Figure 3A:
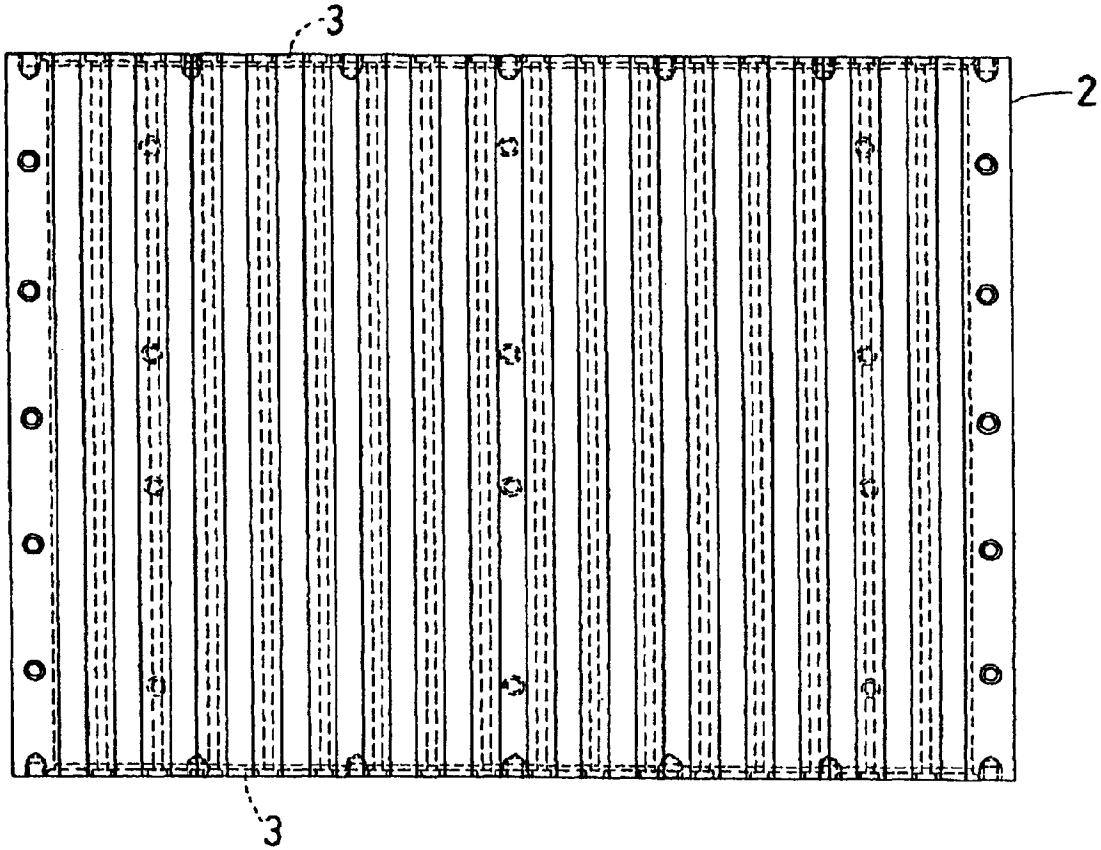
FIG. 3A is a plan view showing a state where a lid is attached to the side face of the block body.

As shown in FIGS. 1A and 1B, the thermal diffusion block 1 is composed of a block body 2, two side plates 3 (FIG. 3) closing opening portions of the block body 2 opening at both side faces thereof, an upper lid 4 fixed to an upper end face of the block body 2, and outer plates 5 fixed to the both side faces of the block body 2. As shown in FIGS. 2A and 2B, the block body 2 has a hollow shape, an upper wall of which has a convexo-concave shape (at an upper portion in a vertical direction in FIG. 2B) having protruding convex portions (concave portions) that extend in parallel with a vertical direction in FIG. 2A to penetrate the inside of the block body 2.

Figure 3B:
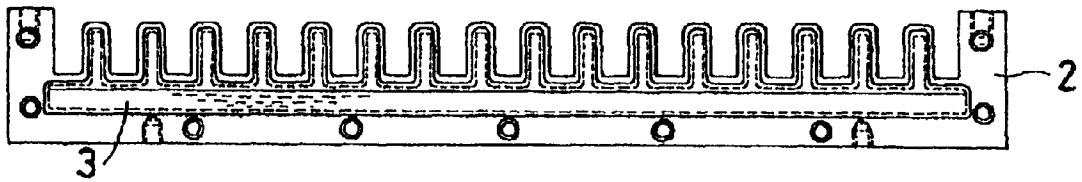
FIG. 3B is a side view showing the state shown in FIG. 3A.

Sealing faces 6, one of which is shown in FIG. 2B, are provided at the upper and lower side faces of the block body 2 in FIG. 2A, and the side plates 3 are attached to the sealing faces 6 to close the opening portions. Each sealing face 6 is formed to be lower than each side face of the block body 2 by an amount corresponding to the thickness of each side plate 3. Each side plate 3 is, as shown in FIG. 3B, formed into a shape corresponding to that of the opening portion opening at the side face of the block body, and closes the opening portion by abutting the sealing face 6.

The upper lid 4 has a plan shape a size of which is identical with that of the block body 2, and as shown in FIG. 1A, is fixed to the end face of the block body 2 with a sealing member 7 interposed therebetween by bolts 8 provided at the right and left sides of the block body 2. The outer plates 5 are, as shown in FIG. 1B, externally fixed to the both side faces of the block body 2 with a sealing member 9 interposed therebetween by bolts 10. The fixation of the outer plates 5 is performed after the upper lid 4 is fixed to the block body 2. Each of the two outer plates 5 has a water communication hole 11 on which a pipe join port 11*a* is provided.

The thermal diffusion block 1 defines a tank chamber 12 sealed by the two side plates 3 closing the hollow portion defined inside the block body 2. A specific amount of refrigerant is enclosed in the tank chamber 12 after deaeration. As shown in FIG. 1A, the tank chamber 12 is composed of a refrigerant chamber 12*a* and a radiation space (vapor passages) 12*b*. The refrigerant chamber 12*a* extends widely in the lateral direction and in the direction perpendicular to the paper space in the figure, with a narrow width (height) in the vertical direction. The radiation space 12*b* is composed of plural protruding portions protruding upward from the refrigerant chamber 12*a*. The refrigerant chamber 12*a* is filled with liquid refrigerant almost at an entire height thereof.

On the other hand, as shown in FIG. 1A, a heating element 13 is fixed to the bottom face of the thermal diffusion block 1 (bottom outer wall of the block body 2), so that heat is transferred from the heating element 13 to liquid refrigerant in the tank chamber 12 via the bottom face of the block body 12. In the thermal diffusion block 1, a water passage portion 15 is provided with a hollow portion that is defined between the convexo-concave portions of the block body 2 and the upper lid 4, and is closed with the two outer plates 5. As shown in FIG. 4, the water passage portion 15 is connected to a cooling water circuit 17 through a water pipe 16 connected to the pipe joint ports 11*a* provided at the outside of the outer plates 5. The cooling water circuit 17 has a pump 18 for circulating cooling water, and a radiator 19 for cooling the cooling water with air.

Next, an operation of the boiling cooler in the first embodiment is explained below.

Liquid refrigerant in the refrigerant chamber 12*a* is boiled and gasified by heat transferred from the heating element 13 through the bottom face of the refrigerant chamber 12*a*, and then flows, as refrigerant vapor, into the radiation space 12*b* of the tank chamber 12. On the other hand, cooling water flows into the water passage portion 15 of the thermal diffusion block 1 by the operation of the pump 18. Accordingly, refrigerant vapor in the radiation space 12*b* is cooled by cooling water flowing in the water passage portion 15, and is condensed to produce liquid drops (condensate) on the inner wall of the tank chamber 12 defining the radiation space 12*b*. The liquid drops drip into the refrigerant chamber 12*a* and return to a part of liquid refrigerant. Cooling water that has received heat from refrigerant vapor has a raised temperature, radiate heat into atmosphere in the radiator 19 to have a lowered temperature, and then returns to the water passage portion 15 again.

The advantages of the first embodiment are as follows.

The thermal diffusion block 1 of the first embodiment is so constructed that refrigerant vapor, which is boiled by heat from the heating element 13 to gasify, is condensed by cooling water. This structure is suitable for cooling the heating element 3 composed of a semiconductor device capable of generating a large thermal flux. A large-sized radiator is not required in comparison with the above-mentioned conventional radiator, resulting in size reduction of the boiling cooler. The limitation for installing the boiling cooler is small, and for example, its mountability to a vehicle having a limited space can be improved significantly. The thermal diffusion block 1 needs not be integrated with the radiator 19, and may be disposed separately from the radiator 19 as shown in FIG. 4.

Further, in the thermal diffusion block 1 of the present embodiment, heat exchange between refrigerant vapor and cooling water (coolant) is performed through the boundary face (wall) between the tank chamber 12 and the water passage portion 15. That is, the boundary face constitutes a heat transfer face. Therefore, the boundary face formed into the convexo-concave shape can increase a heat transfer area (radiation area). Further, liquid face fluctuation of refrigerant in the tank chamber 12, which can be caused by inclination of the thermal diffusion block 1, can be lessened in comparison with a case where the boundary face between the tank chamber 12 and the water passage portion 15 is flat. Therefore, the radiation performance can be suppressed from deteriorating due to the liquid face fluctuation.

Second Embodiment

Figure 5:
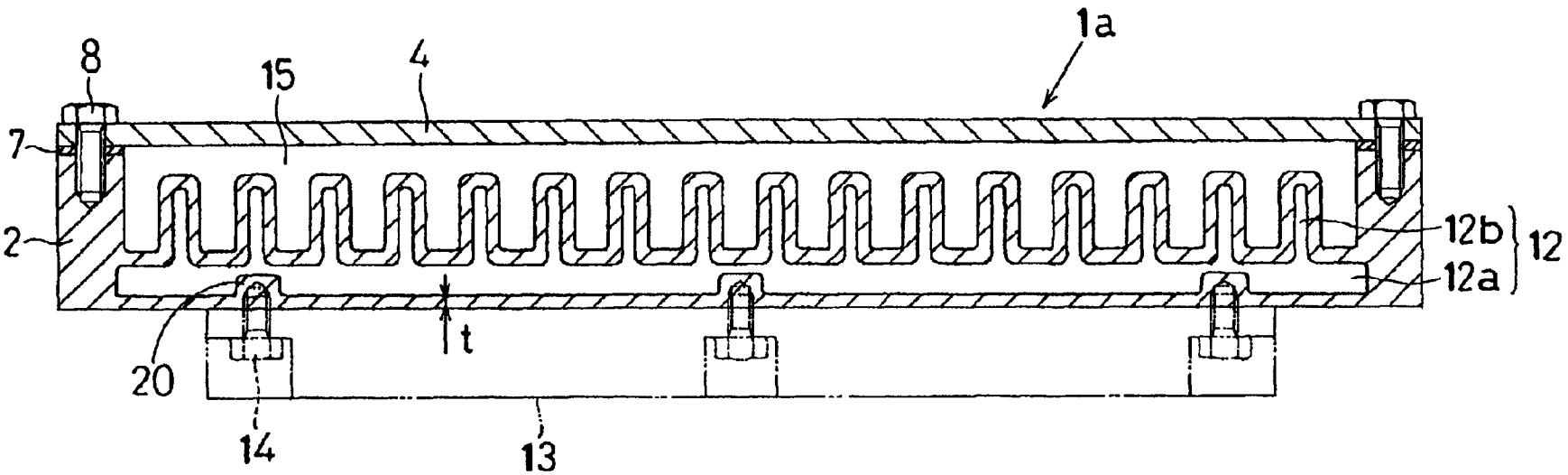
FIG. 5 is a cross-sectional view showing a thermal diffusion block in a second embodiment of the invention.

FIG. 5 shows a cross-section of a thermal diffusion block 1*a* according to a second embodiment, which corresponds to that shown in FIG. 1A in the first embodiment. In this and following embodiments, the same parts as those shown and explained in the first embodiment are designated with the same reference numerals.

In the thermal expansion diffusion block 1*a* of this embodiment, thickness t of the bottom wall of the block body 2, i.e., between the bottom face of the refrigerant chamber 12*a* and the outer bottom face of the block body 2 to which the heating element 13 is fixed, is thinned except for portions 20 where screw holes for the bolts 14 are formed. In this case, in comparison with the first embodiment, heat from the heating element 13 is efficiently transferred to liquid refrigerant in the refrigerant chamber 12*a*, so that heat transfer with boiling of refrigerant can be performed efficiently. As a result, the radiation performance is improved.

Third Embodiment

Figure 6:
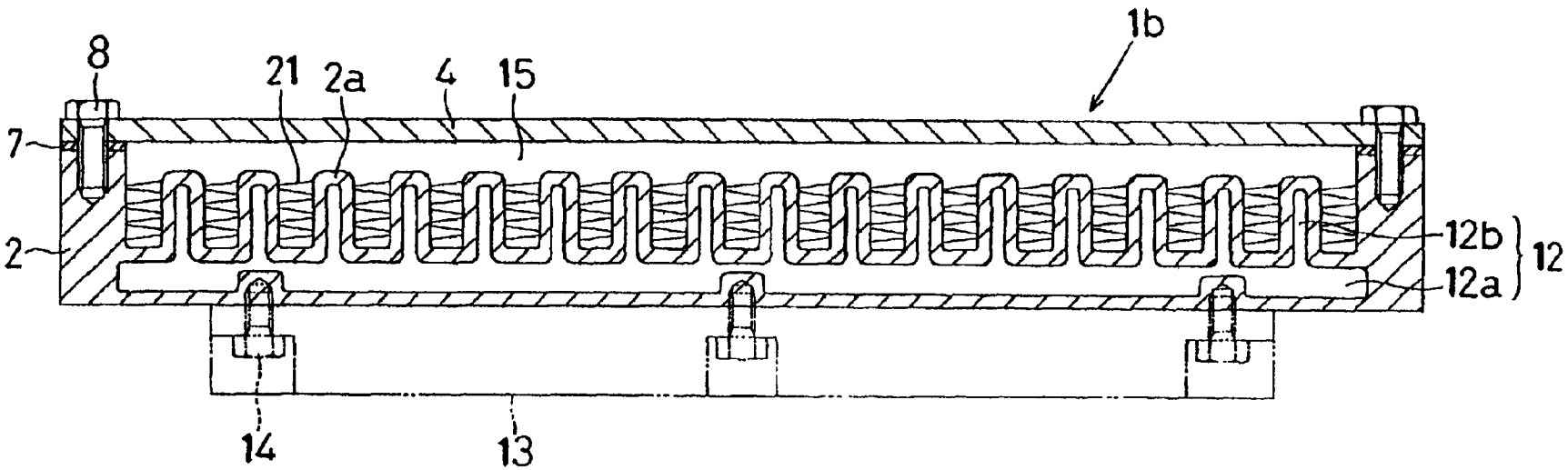
FIG. 6 is a cross-sectional view showing a thermal diffusion block in a third embodiment of the invention.

FIG. 6 shows a cross-section of a thermal diffusion block 1*b* according to a third embodiment of the invention, which corresponds to that shown in FIG. 1A in the first embodiment. The thermal diffusion block 1*b* has radiation fins 21 disposed in the water passage portion 15, in addition to the constitution of the second embodiment. The radiation fins 21 are made of aluminum, and as shown in FIG. 6, each radiation fin is inserted into a concave portion (space) defined between neighboring two protruding portions 2*a* of the block body 2 and is brazed to the outer walls of the protruding portions 2*a*. Because the radiation fins 21 increase the heat transfer area (radiation area), the radiation performance is improved.

Fourth Embodiment

Figure 7:
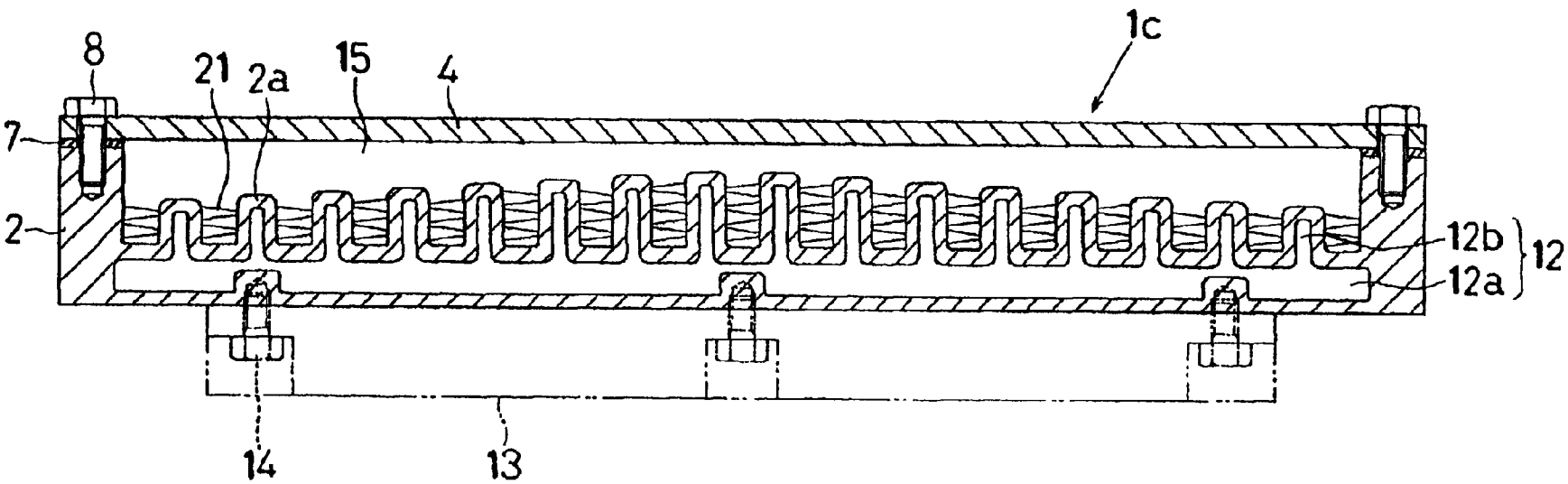
FIG. 7 is a cross-sectional view showing a thermal diffusion block in a fourth embodiment of the invention.

FIG. 7 shows a cross-section of a thermal diffusion block 1*c* according to a fourth embodiment, which corresponds to that shown in FIG. 1A in the first embodiment. In the thermal diffusion block 1*c* in this embodiment, the height of the protruding portions 2*a* of the block body 2 is the largest at the generally central portion in the lateral direction of the tank chamber 12 (in the direction perpendicular to the paper space of the figure), and is gradually decreased toward the both sides in the lateral direction of the tank chamber 12.

In this constitution, for example, if the thermal diffusion block 1*c* is mounted on a vehicle and is inclined when the vehicle travels, the amount of refrigerant enclosed in the protruding portions 2*a* (radiation space 12*b*) becomes small as compared to the cases in the first to third embodiments because the height of the protruding portions 2*a* is small at the both sides in the lateral direction of the tank chamber 12. As a result, the liquid face fluctuation can be suppressed when the thermal diffusion block 1*c* is inclined. The bottom surface of the refrigerant chamber 12 where refrigerant boils can be easily prevented from being exposed, i.e., from being uncovered by refrigerant, so that the radiation performance required for cooling the heating element 13 can be maintained appropriately.

Fifth Embodiment

Figure 8:
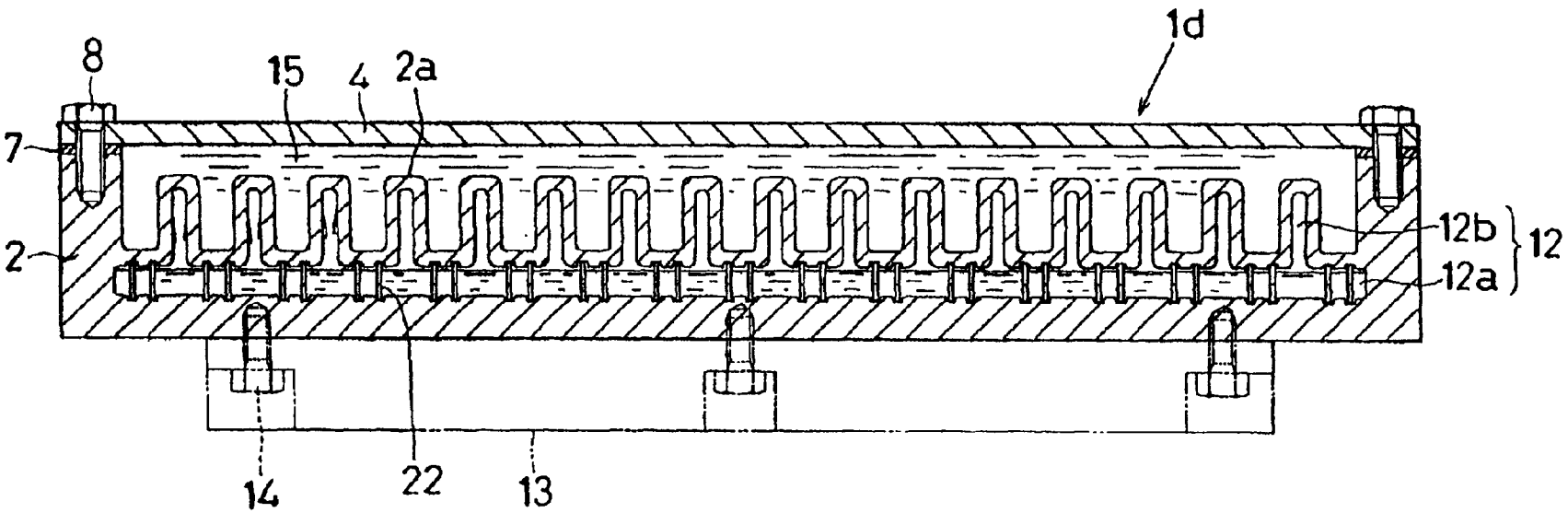
FIG. 8 is a cross-sectional view showing a thermal diffusion block in a fifth embodiment of the invention.
Figure 9A:
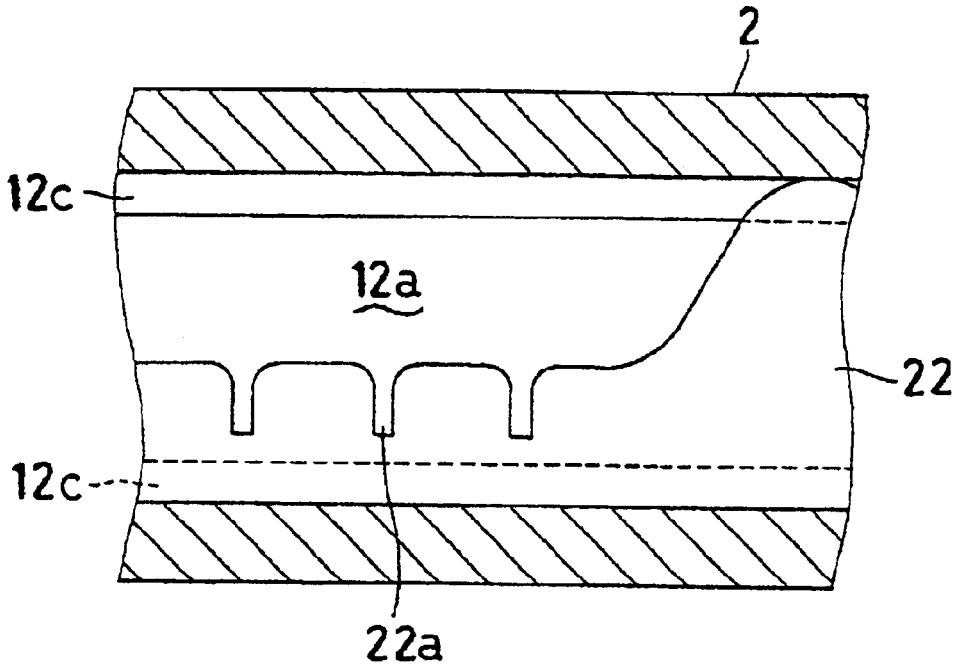
FIGS. 9A and 9B are cross-sectional views showing a tank chamber in which an inner plate is disposed, in the fifth embodiment.
Figure 9B:
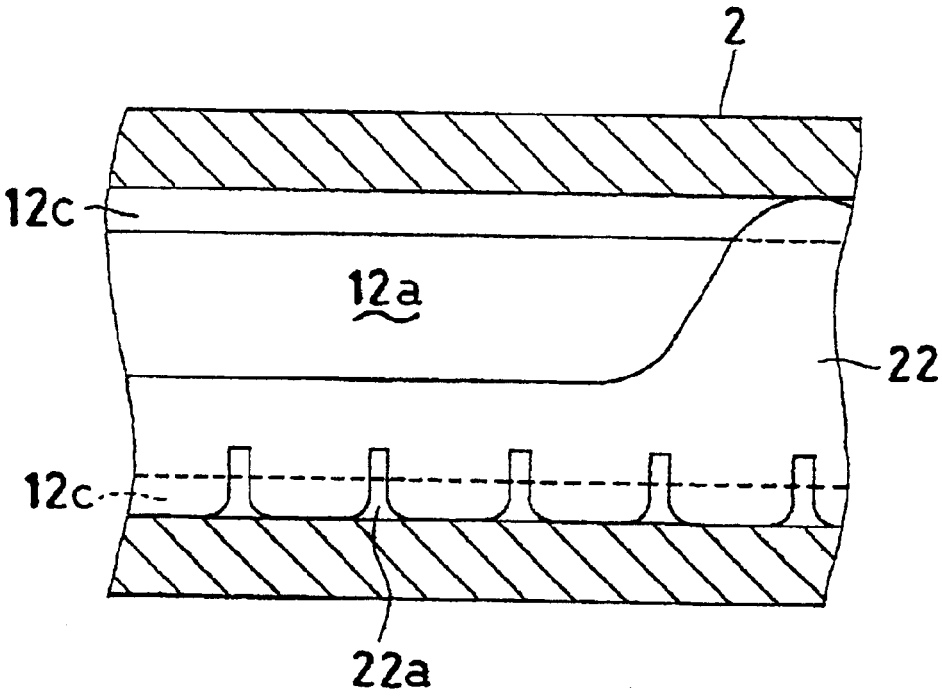

FIG. 8 shows a cross-section of a thermal diffusion block 1*d* according to a fifth embodiment of the invention, which corresponds to that shown in FIG. 1A in the first embodiment. The thermal diffusion block 1*d* in this embodiment has inner plates 22 disposed in the refrigerant chamber 12*a*. The inner plates 22 are made of, for example, metallic plate such as aluminum having sufficient thermal conductivity. Each inner plate 22 is, as shown in FIGS. 9A and 9B, held by being inserted into groove portions 12*c* formed on the wall surface of the refrigerant chamber 12*a*. As shown in FIGS. 9A and 9B, the inner plate 22 can have notch portions 22*a* at either side thereof. The inner plates 22 disposed in the refrigerant chamber 12*a* can increase a boiling area in the refrigerant chamber 12*a* to improve the refrigerant performance.

Sixth Embodiment

Figure 10:
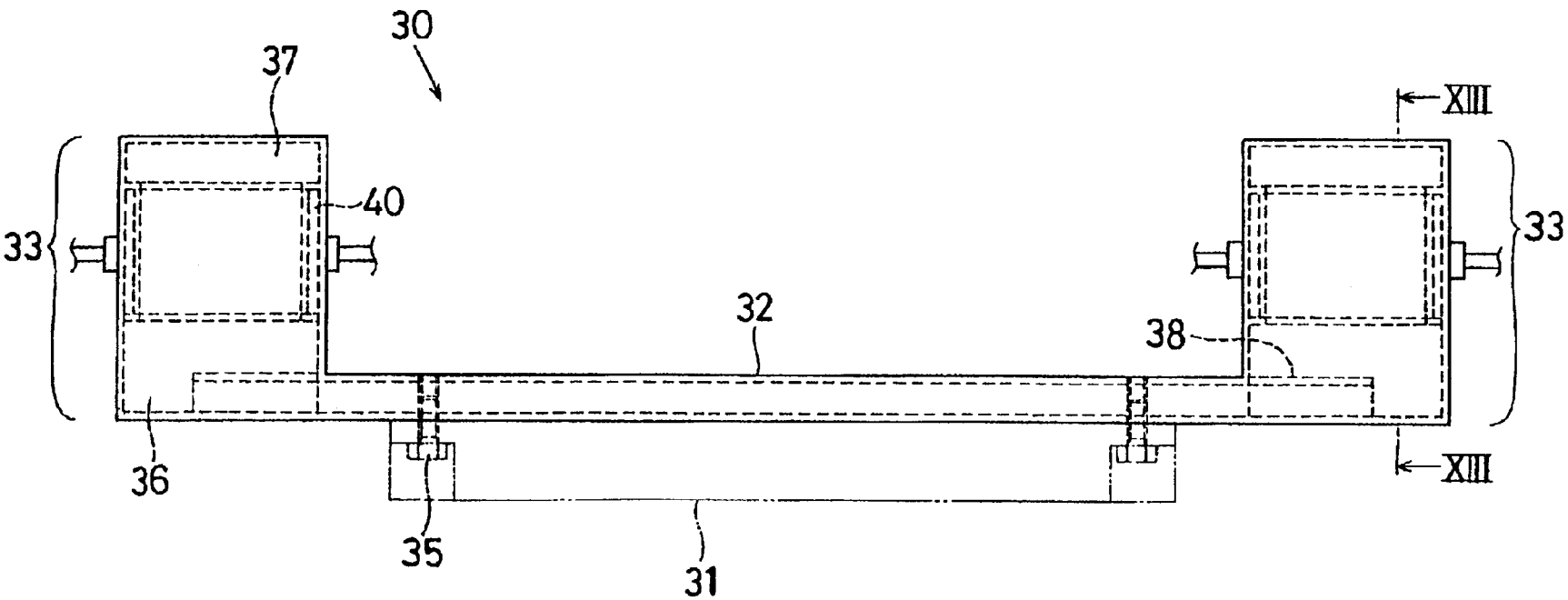
FIG. 10 is a front view showing a boiling cooler in a sixth embodiment of the invention.
Figure 11:
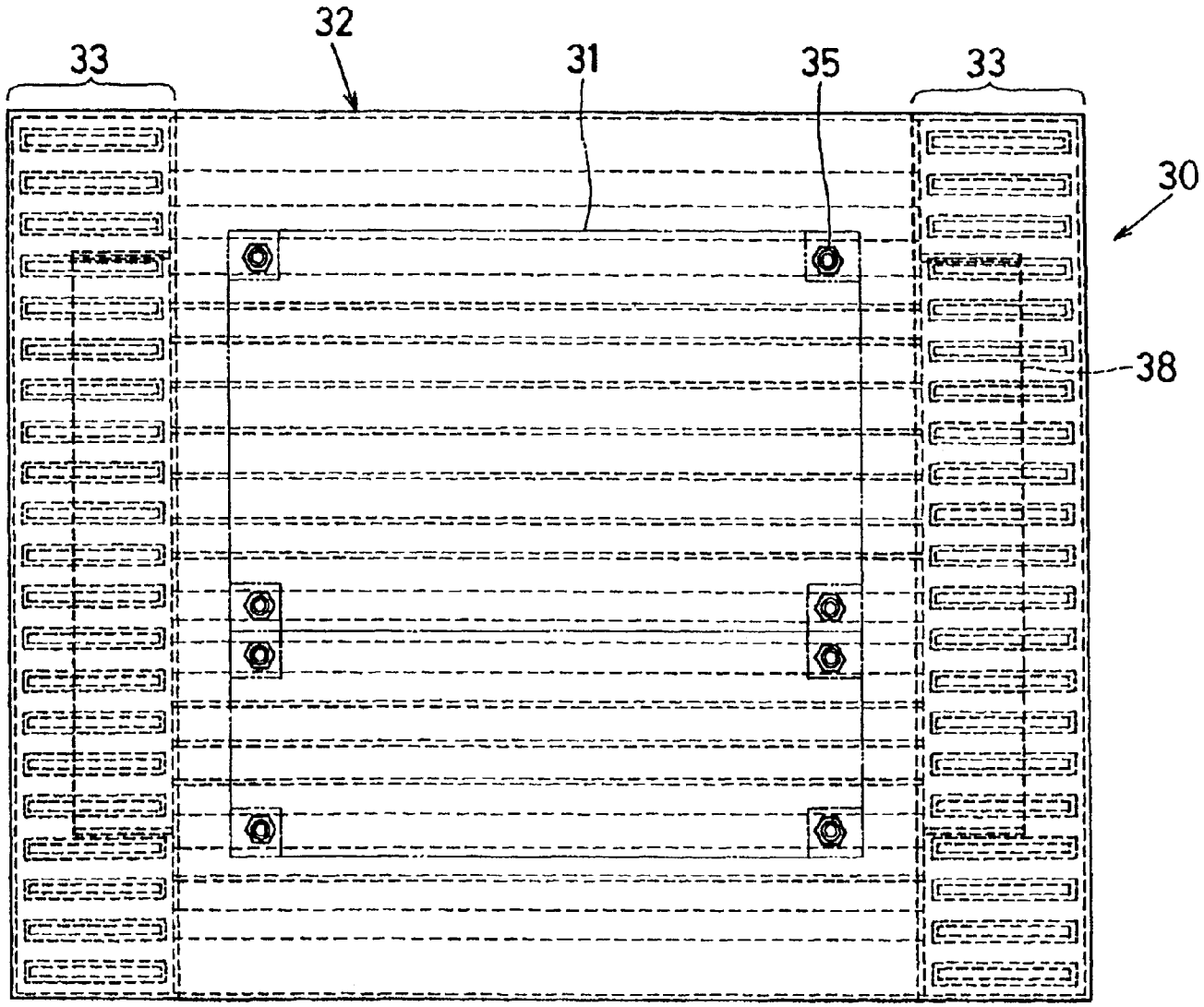
FIG. 11 is a bottom view showing the boiling cooler in the sixth embodiment.
Figure 12:
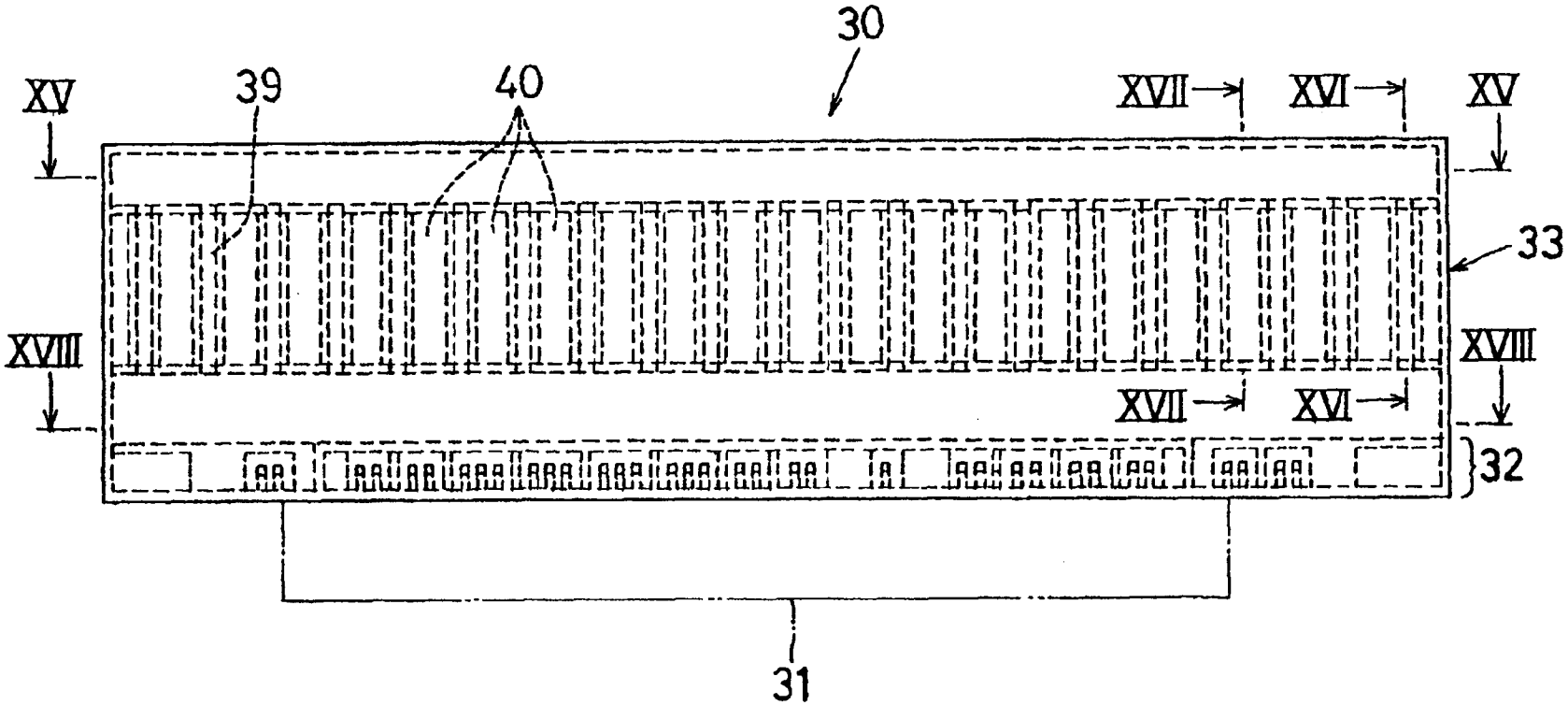
FIG. 12 is a side view showing the boiling cooler in the sixth embodiment.

FIGS. 10 to 12 shows a contour of a boiling cooler 30 in a sixth embodiment of the invention. FIG. 10 is a front view of the boiling cooler 30, FIG. 11 is its bottom view (plan view from a side of an attachment face of a heating element), and FIG. 12 is a side view (plan view from a side face of a radiating portion).

The boiling cooler 30 in this embodiment is, for example, mounted on an electric vehicle to cool an IGBT module (heating element 31) constituting an inverter circuit for a vehicular motor. As shown in FIGS. 10 to 12, the boiling cooler 30 is composed of a refrigerant vessel (tank) 32 for storing liquid refrigerant therein, and radiators 33 for cooling vapor of refrigerant that is boiled upon receiving heat from the heating element 31, which are made of metallic materials (for example, aluminum) having sufficient thermal conductivity.

The refrigerant vessel 32 is a thin hollow member having a small thickness (height) in the vertical direction and a large dimension in the horizontal direction (lateral and longitudinal directions). Both ends of the refrigerant vessel 32 in the longitudinal direction are open and its inside is divided into several passage portions.

Figure 13:
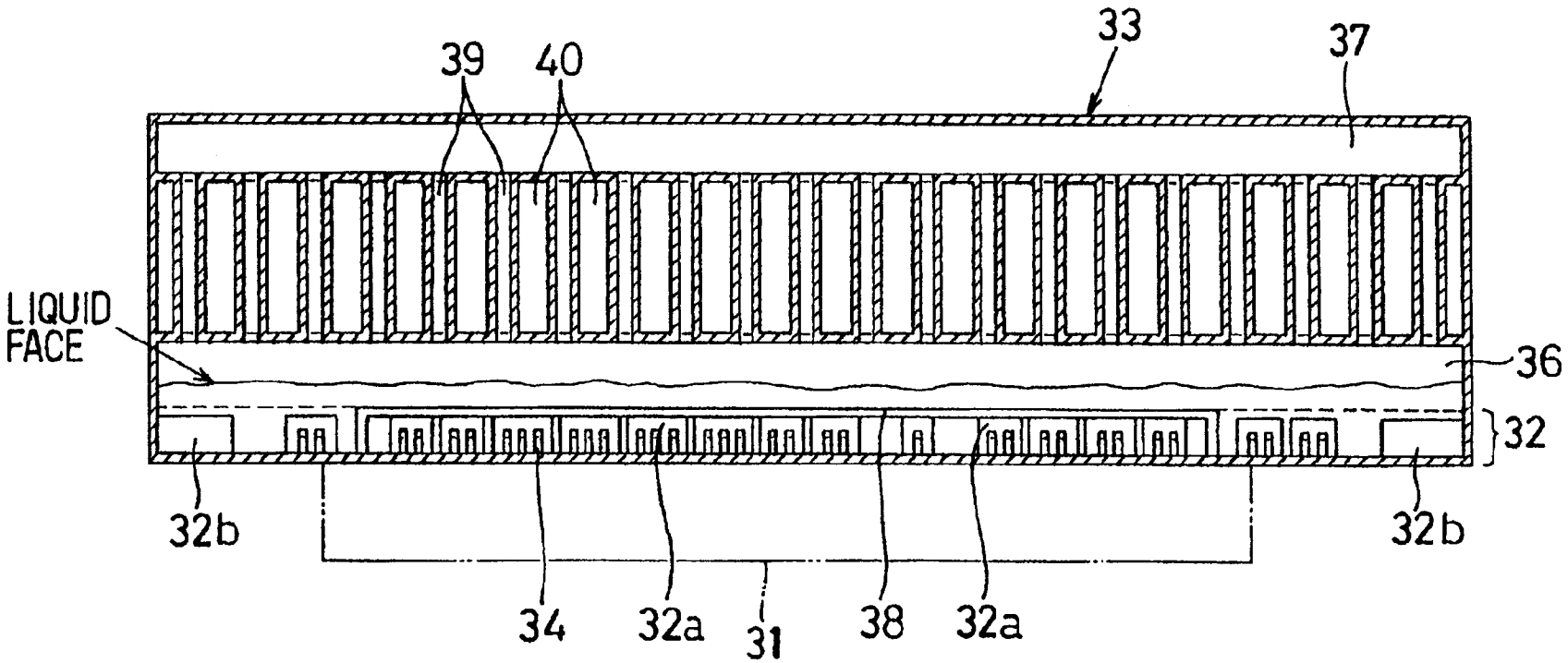
FIG. 13 is a cross-sectional view taken along line VIII—VIII in FIG. 10.
Figure 14A:
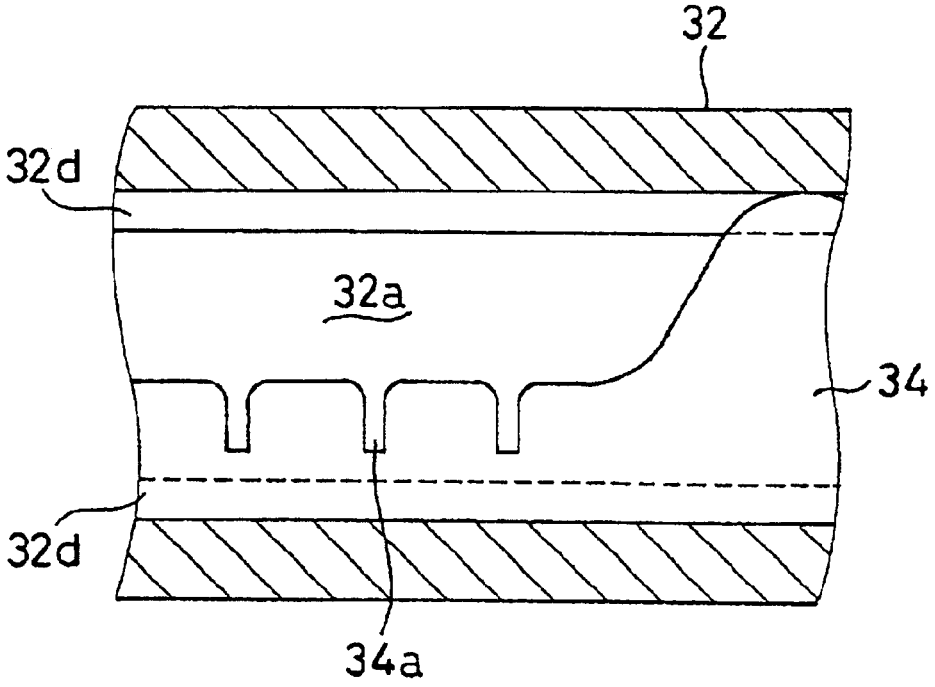
FIGS. 14A and 14B are cross-sectional views showing a refrigerant vessel in which an inner fin is disposed, in the sixth embodiment.
Figure 14B:
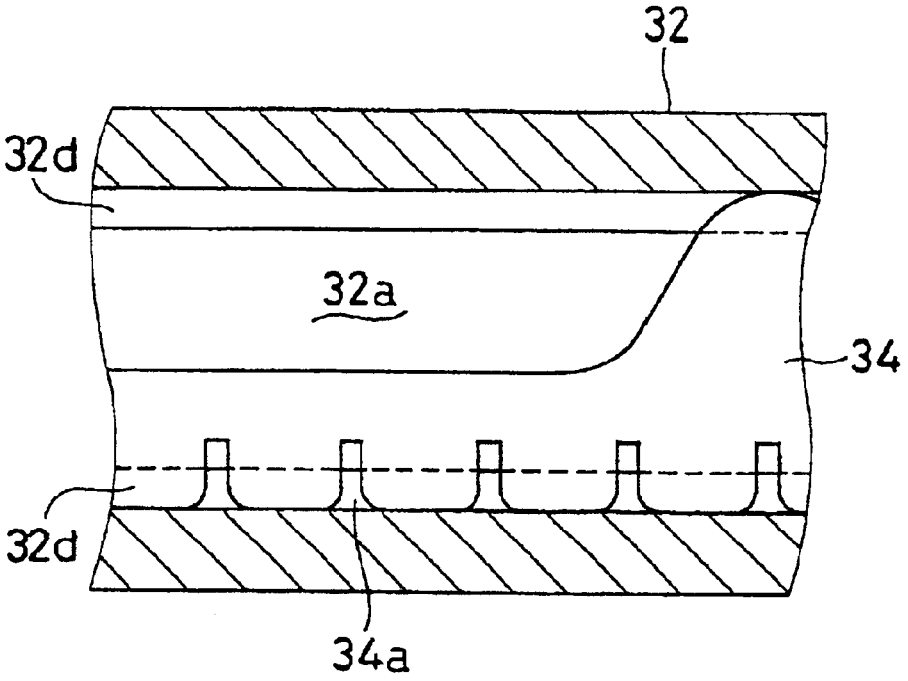

Referring to FIG. 13, inner fins 34 are inserted into at least some of the passage portions (vapor outflow passages 32*a*) contained in the region (boiling portion) to which the heating element 31 is attached. Each inner fin 34 is, as shown in FIGS. 14A and 14B, formed with plural recess portions 34*a* to increase a heat transfer area (boiling area). The location of the inner fin 34 is determined by grooves 32*d* formed on the inner wall of the refrigerant vessel 32 into which the inner fin 34 is inserted. The heating element 31 is closely attached to the lower side outer surface of the refrigerant vessel 32, and is fixed thereto by bolts 35.

Referring to FIG. 10, the radiators 33 are respectively composed of a pair of tanks (lower tank 36 and upper tank 37) and a heat exchange part (described below), and are provided at the both sides (right and left sides) of the refrigerant vessel 32 in the lateral direction. The lower tank 36 is provided to communicate with the passage portions of the refrigerant vessel 32, and stores liquid refrigerant in cooperation with the refrigerant vessel 32. Therefore, the right side radiator 33 and the left side radiator 33 communicate with each other through the refrigerant vessel (passage portions) 32 at the respective lower tanks 36. Vapor of refrigerant boiled in the refrigerant vessel 32 flows in the right and left directions in the vapor outflow passages 32*a* and enters the lower tanks 36. On the other hand, as shown in FIG. 13, liquid refrigerant is held with a liquid surface, a position of which is higher than the upper surface of the refrigerant vessel 32. That is, the inside of the refrigerant vessel 32 is filled with liquid refrigerant.

Figure 18:
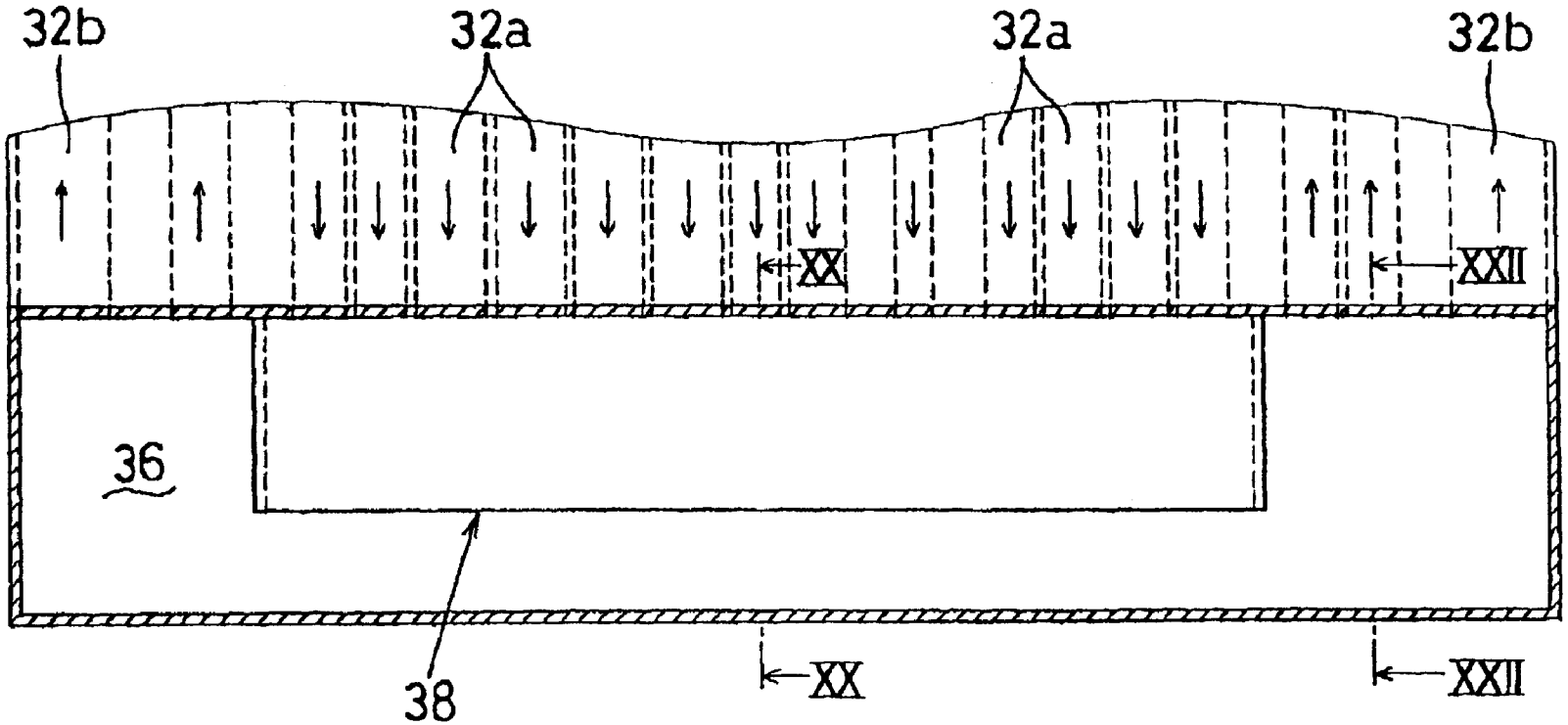
FIG. 18 is a cross-sectional view taken along line XVIII—XVIII in FIG. 12.
Figure 20:
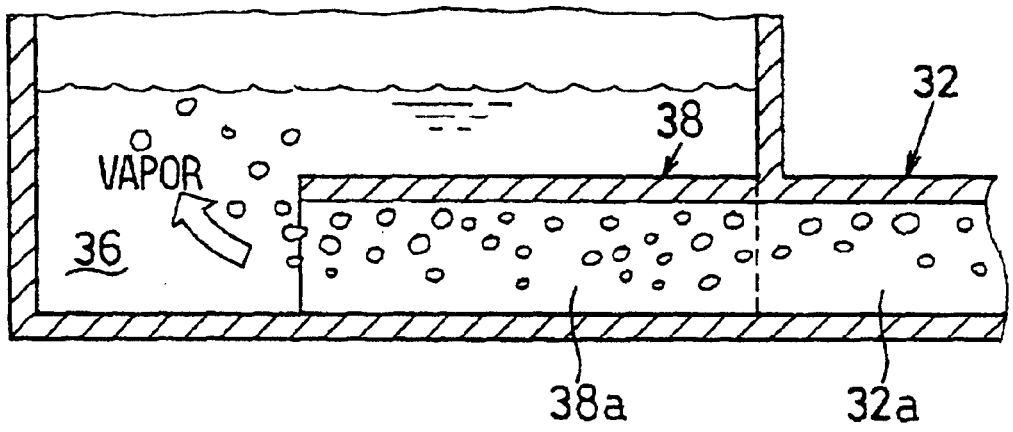
FIG. 20 is a cross-sectional view taken along line XX—XX in FIG. 18.

Referring to FIGS. 13 and 18, each of the lower tank 36 holds a refrigerant flow control plate 38 therein. The refrigerant flow control plate 38 forms an extension passage portion 38*a* for extending the vapor outflow passages 32*a* into the lower tank 36 to prevent, in the lower tank 36, interference between refrigerant vapor coming out of the vapor outflow passages 32*a* and condensate returned from the radiator 33 (FIG. 20). Each upper tank 37 is positioned above the heat exchange part, and faces the lower tank 36 through the heat exchange part interposed therebetween in the vertical direction.

Figure 15:
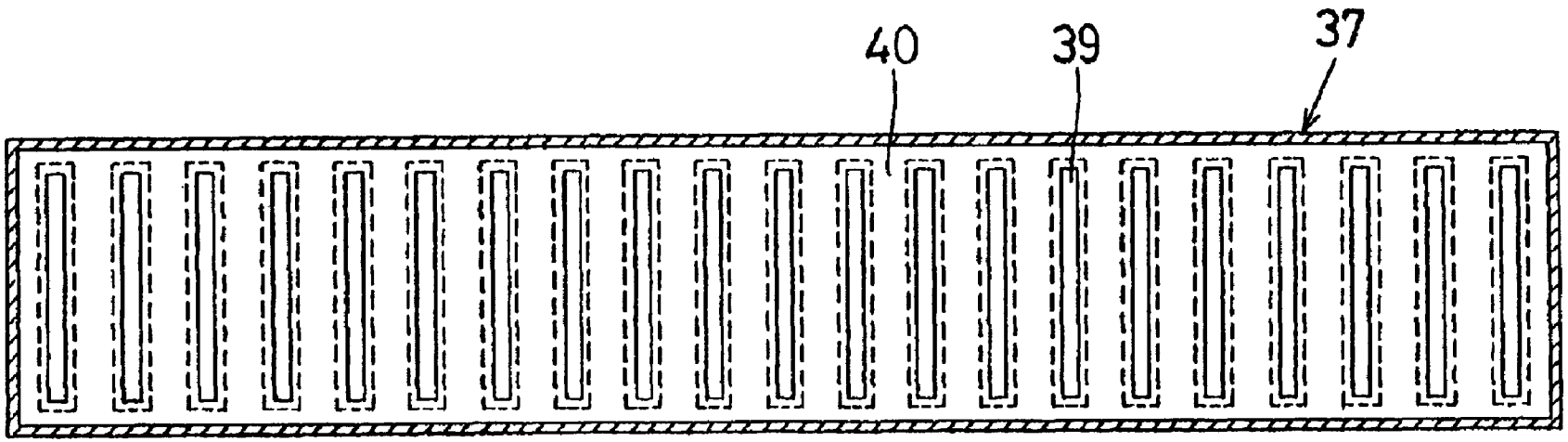
FIG. 15 is a cross-sectional view taken along line XV—XV in FIG. 12.

The heat exchange part is, as shown in FIG. 13, composed of plural radiation passages 39 connecting the lower tank 36 and the upper tank 37, and water jackets 40 provided around the radiation passages 39. Heat exchange is performed between refrigerant vapor flowing in the radiation passages 39 and cooling water flowing in the water jackets 40. The radiation passages 39 respectively have an elongated rectangular opening in cross-section, and are arranged with an approximately constant interval in the width direction of the tanks 36, 37 (lateral direction in FIG. 15).

Figure 16:
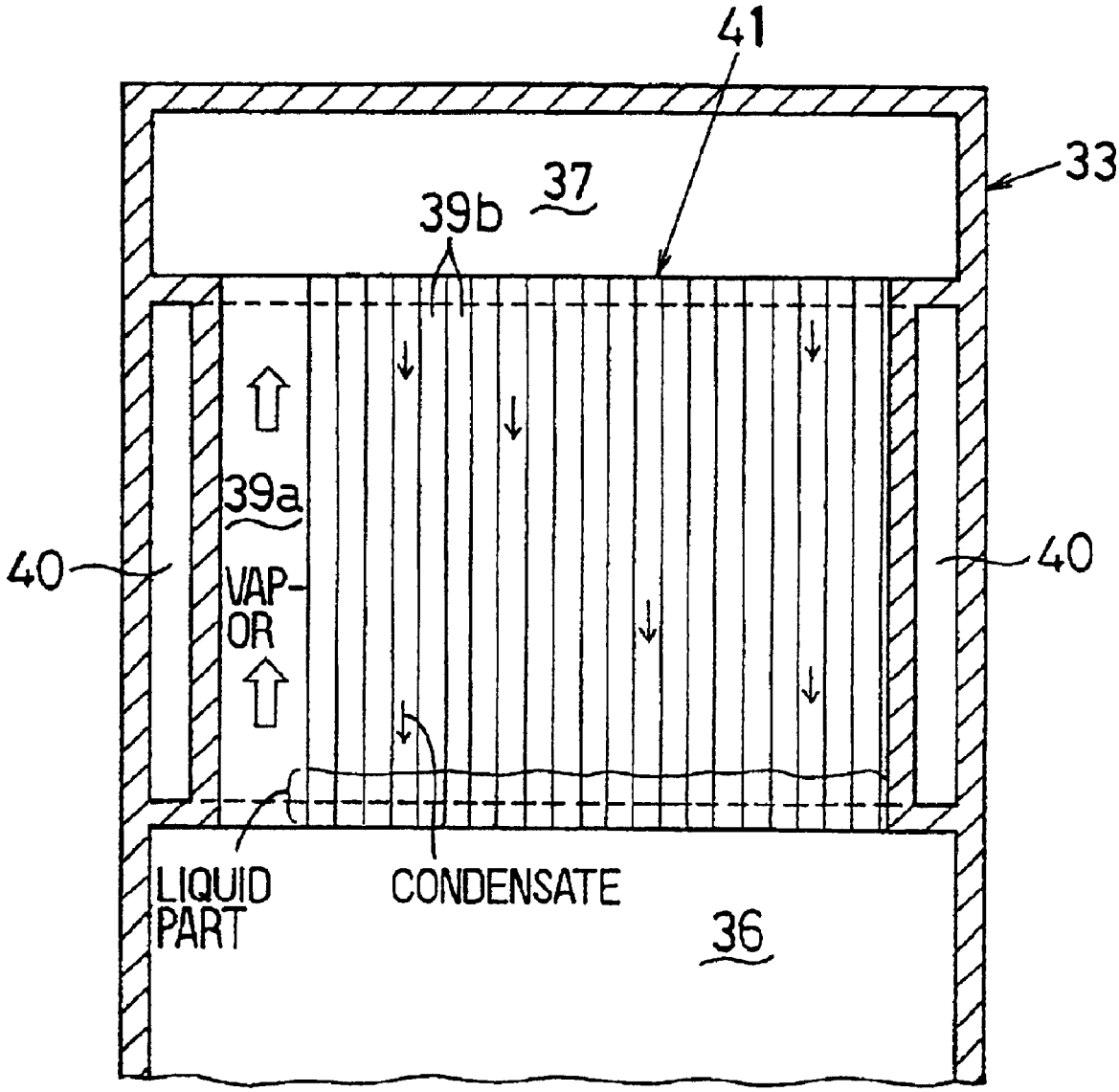
FIG. 16 is a cross-sectional view taken along line XVI—XVI in FIG. 12.
Figure 17:
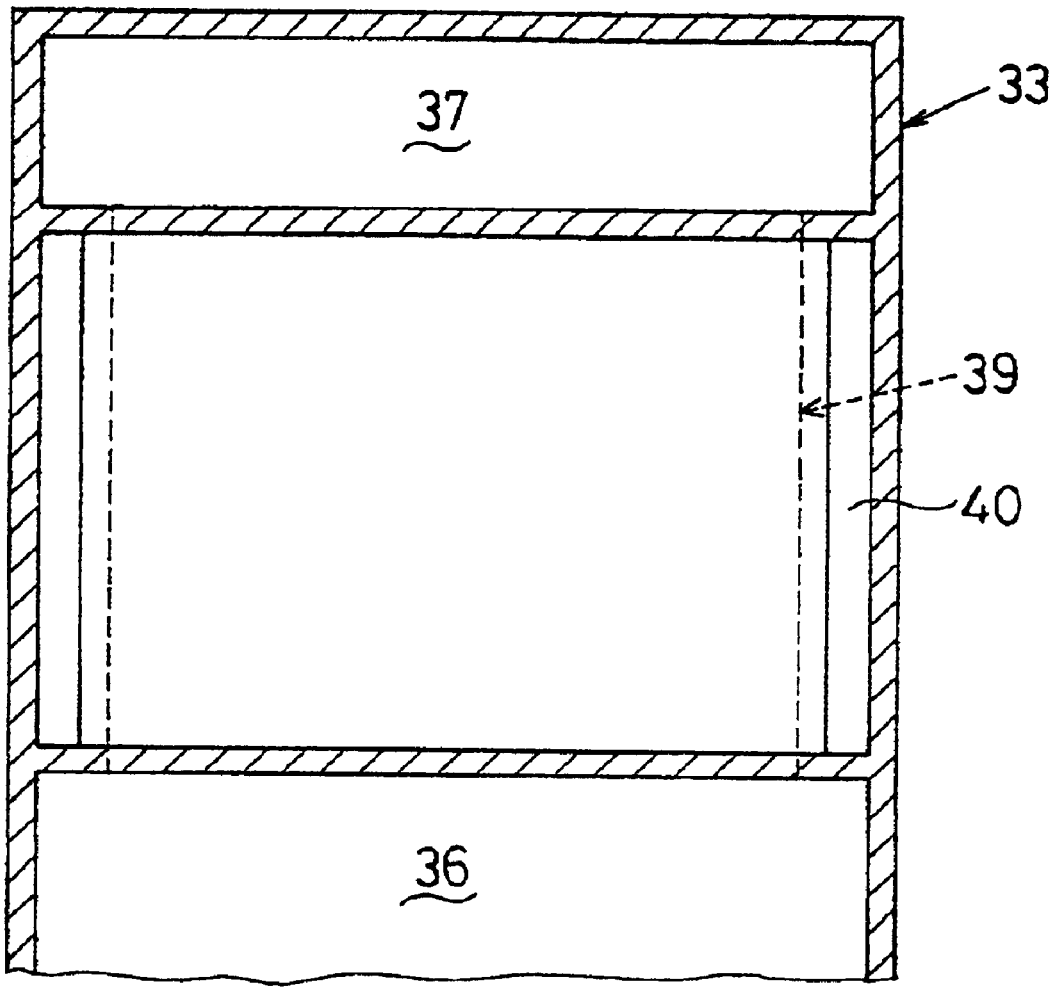
FIG. 17 is a cross-sectional view taken along line XVII—XVII in FIG. 12.

Referring to FIG. 16, an inner fin 41 is inserted into an inside of each radiation passage 39. The inner fin 41 is, for example, formed from a thin metallic (such as aluminum) plate bent into a corrugated shape with a given pitch. The inner fin 14 is biased toward one side (in the right direction in FIG. 16) in the radiation passage 39. Accordingly, the inside of the radiation passage 39 is divided into a first passage portion (vapor passage portion 39*a*) defined at the other side of the inner fin 41 (at the outside of the inner fin 41), and a second passage portion (liquid passage portion 39*b*) including plural passages defined by the inner fin 41 at the given pitch.

Figure 19:
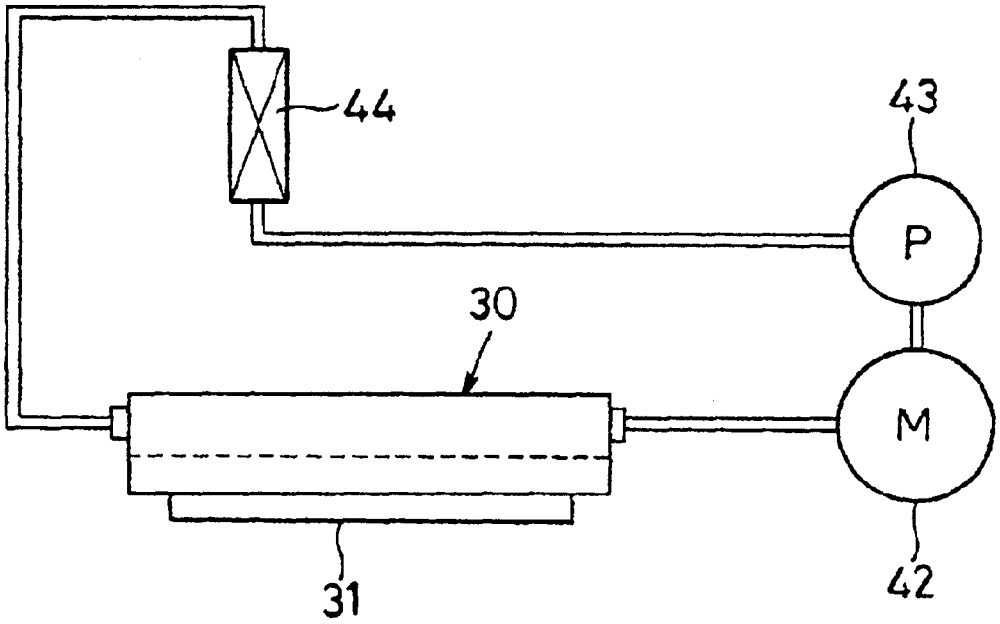
FIG. 19 is a diagram showing a cooling water circuit of a water-cooling system in the sixth embodiment.

The water jackets 40 constitute passages in which cooling water flows. The water jackets 40 surround the peripheries of the respective radiation passages 39 and the entire periphery of the heat exchange part. The water jackets 40 are further connected to the cooling water circuit in which cooling water circulates. The cooling water circuit is, as shown in FIG. 19, used for a cooling system for cooling with water a motor 42 for moving an electric vehicle, and has a pump 43 for circulating cooling water and a radiator 44 for cooling the cooling water with air.

Next, the operation of the present embodiment is explained below.

Liquid refrigerant stored in the refrigerant vessel 32 boils upon receiving heat from the heating element 31, and as shown in FIG. 20, flows from the vapor outflow passages 32*a* into the lower tank 36 through the extension passage portion 38*a*. After that, refrigerant vapor flows from the lower tank 36 into the vapor passage portions 39*a* in the radiation passages 39, rises in the vapor passage portions 39*a*, and flows into the upper tank 37. It further flows from the upper tank 37 into the liquid passage portions 39*b* defined by the inner fin 41 at the specific pitch. The refrigerant vapor entering the liquid passage portions 39*b* is cooled by cooling water flowing in the water jackets 40, and is condensed and liquefied on the surfaces of the inner fins 42 and on the inner walls of the radiation passages 39.

Condensate liquefied in the liquid passage portions 39*b* is collected and held at the lower portion of the inner fin 41 due to a surface tension, and as shown in FIG. 16, forms a liquid part at the lower portion of the inner fin 41. This liquid part prevents refrigerant vapor from entering the liquid passage portions 39*b* from the lower tank 36 directly, and contributes to form a refrigerant circulating flow in the radiation passages 39 desirably. The condensate collected in the liquid part drops sequentially into the lower tank 36 from the liquid part due to a pressure of refrigerant vapor rising in the vapor passage portions 39*a*.

For example, this boiling cooler 30 is mounted on the electric vehicle so that the longitudinal direction of the refrigerant vessel 32 (lateral direction in FIG. 10) is parallel to the front and rear direction of the vehicle and to the horizontal direction. In this case, when the vehicle travels on a slope, the refrigerant vessel 32 may be inclined with respect to the horizontal plane. Specifically, as shown in FIG. 21, the refrigerant vessel 32 may be inclined with the right side higher than the left side thereof.

In this case, refrigerant vapor produced by the boiling therein rises (moves toward the right side) along the inclined refrigerant vessel 32, and flows into the lower tank 36 of the right side radiator 33. After that, as mentioned above, condensate cooled in the radiator 33 drops in the lower tank 36. At that time, condensate dropped from the liquid part into the lower tank 36 mainly enters, from both outer sides of the refrigerant control plate 38, a passage portion (liquid return passage) 32*b* of the refrigerant vessel 32 (FIGS. 18 and 22). The condensate entering the liquid return passage 32*b* then flows in the inclined refrigerant vessel 32, enters the lower tank 36 of the left side radiator 33, and then returns to the boiling portion in the refrigerant vessel 32 from the lower tank 36 again.

The boiling cooler 30 in the sixth embodiment has a structure different from those of the thermal radiation blocks explained in the first to fifth embodiments; however, it is the same as those in the point that vapor of refrigerant, which is boiled and gasified upon receiving heat from the heating element 31, is cooled by water. Therefore, the boiling cooler 30 is also suitable for cooling the heating element 31 including a semiconductor device and the like having a large thermal flux.

Also, because the radiators 33 are provided at the both sides of the refrigerant vessel 32, at least one of the radiators 33 performs heat exchange between refrigerant vapor and cooling water if there arises a positional difference in height between the two radiators 33. As a result, a stable radiation performance can be attained without being lessened. Especially when the boiling cooler 30 is mounted on a vehicle, this boiling cooler 30 is very effective because the radiation performance can be exhibited stably even if the radiation vessel 32 is inclined to either side by the vehicle traveling on a slope or the like.

Seventh Embodiment

Figure 23:
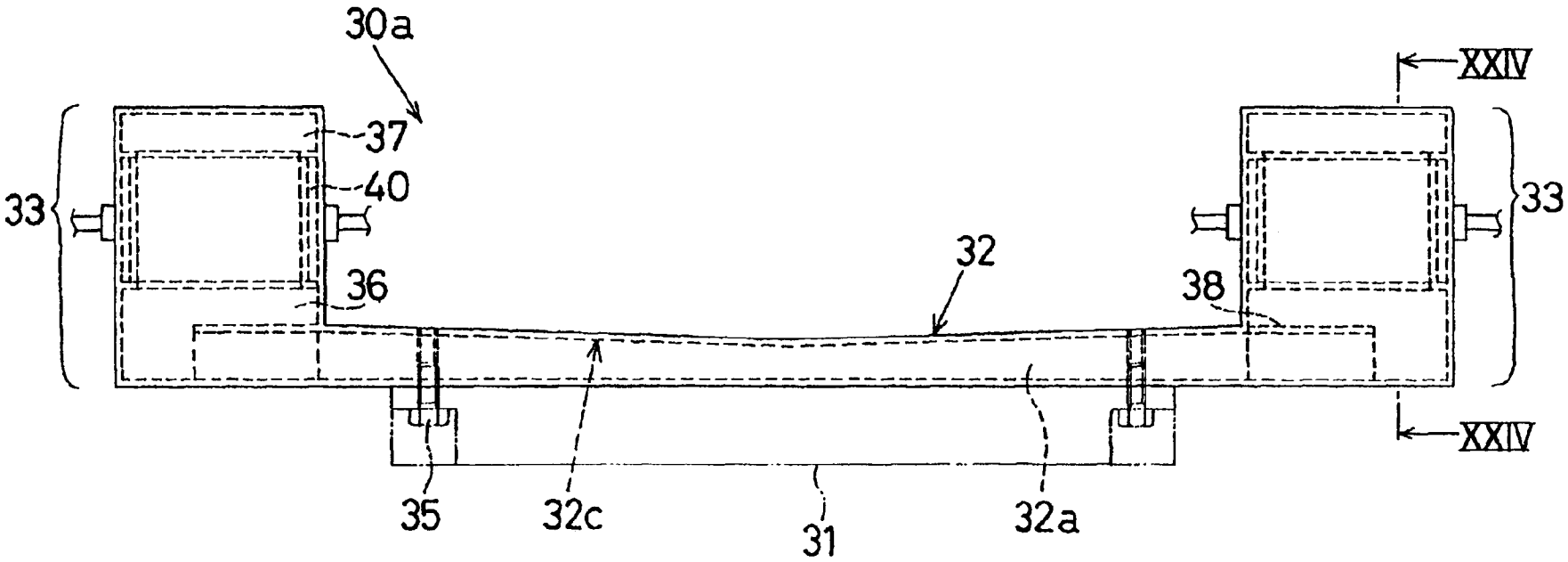
FIG. 23 is a front view showing a boiling cooler in a seventh embodiment of the invention.
Figure 24:
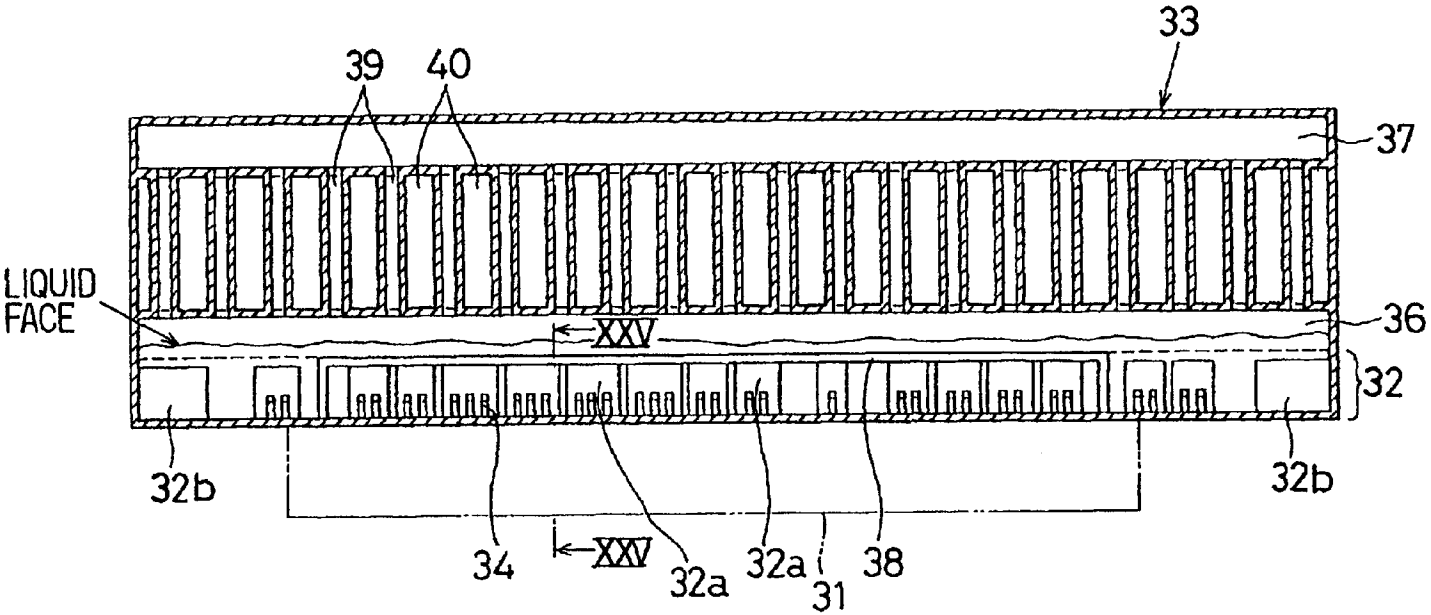
FIG. 24 is a cross-sectional view taken along line XXIV—XXIV in FIG. 23.
Figure 25:
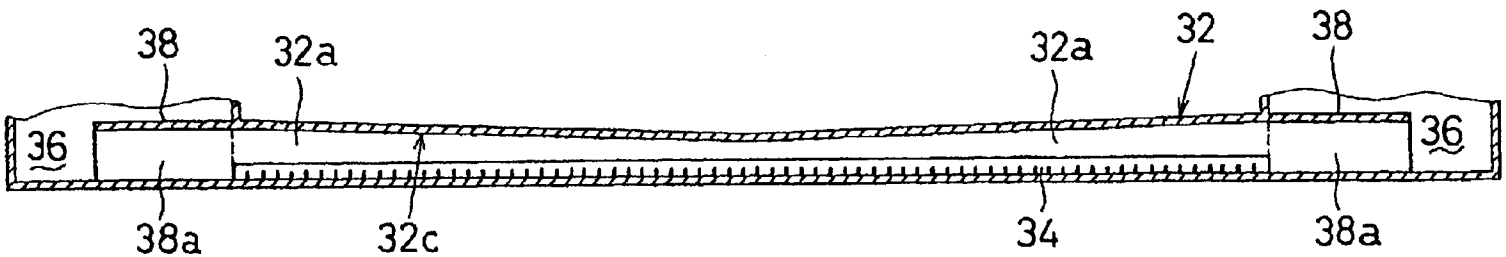
FIG. 25 is a cross-sectional view taken along line XXV—XXV in FIG. 24.

A boiling cooler 30*a* according to a seventh embodiment of the invention is a modification of the boiling cooler 30 in the sixth embodiment, and is explained with reference to FIGS. 23 to 25. In this and following embodiments, the same parts as those in the sixth embodiment are designated with the same reference numerals.

The boiling cooler 30*a* in this embodiment has a refrigerant vessel 32 with an upper wall 32*c* that constitutes an upper surface of the passage portion. As shown in FIGS. 23 and 25, the upper wall 32*c* is bowed inward, and gently inclined upward from the central portion to both sides in the longitudinal direction (lateral direction in FIG. 25). Therefore, the vertical width of the passage portion is minimum at the central portion, and is increased gradually toward the outlet sides. The other features are substantially the same as those in the sixth embodiment.

According to the boiling cooler 30*a* in the seventh embodiment, the upper wall 32*c* of the refrigerant vessel 32 is bowed inward, and is gently inclined upward from the central portion toward the both sides in the longitudinal direction thereof. Therefore, even when the refrigerant vessel 32 is disposed generally horizontally, refrigerant vapor produced in the refrigerant vessel 32 easily flows toward the outlet sides of the vapor outflow passages 32*a* along the inclined (bowed) upper wall 32*c*. As a result, refrigerant vapor kept remaining in the refrigerant vessel 32 is decreased (or eliminated), and refrigerant vapor can flow into the radiators 33 smoothly. The radiators 33 can be utilized effectively, and the radiation performance can be exhibited stably.

Refrigerant vapor produced at the boiling portion flows toward the right and left sides in the vapor outflow passages 32*a* defined by the upper wall 32*c* that is low at the central portion and is heightened towards the outlet sides. Because of this, the amount of refrigerant vapor is increased gradually from the central portion toward the outlet sides in the refrigerant outflow passages 32. The vertical width of the refrigerant vessel 32 (passage portion) is set to be the smallest at the central portion and to be gradually increased (widened) toward the outlet sides in the longitudinal direction thereof. Thus, the passage width is set in accordance with the amount of refrigerant vapor. In consequence, the amount of refrigerant can be reduced without lessening the radiation performance, and cost reduction can be achieved by the reduced amount of refrigerant.

Figure 26A:
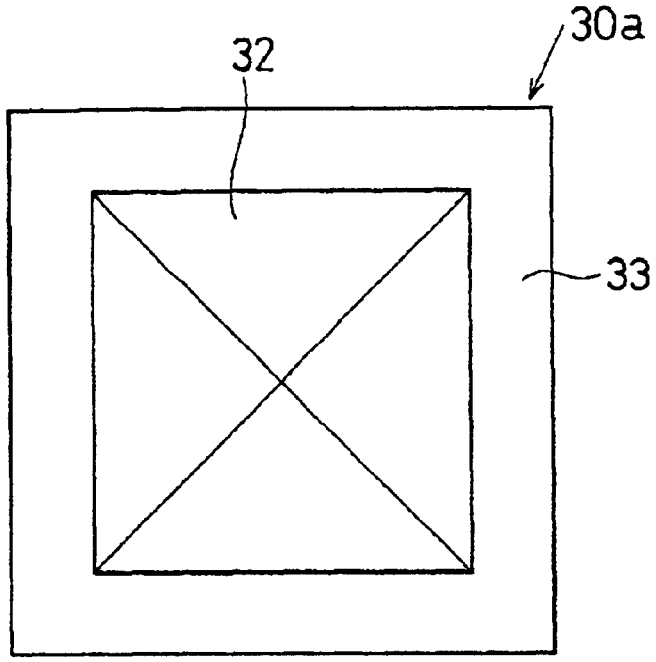
FIGS. 26A and 26B are upside views showing modifications of the boiling cooler in the seventh embodiment.
Figure 26B:
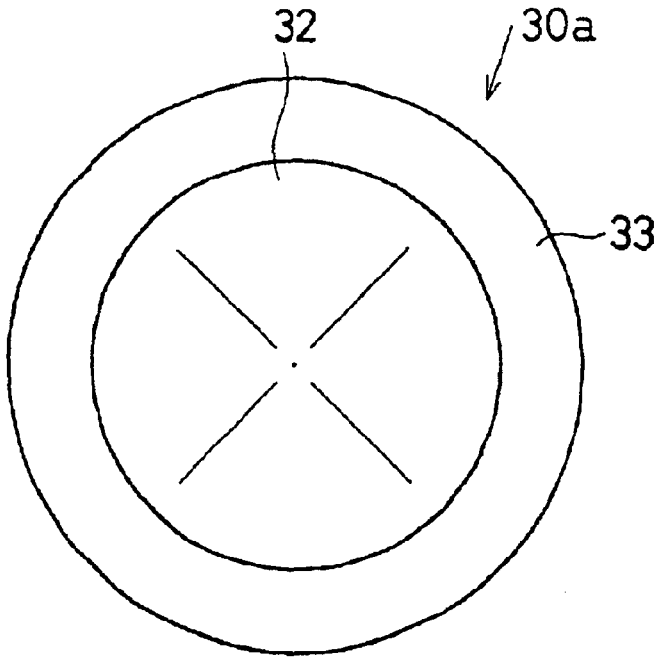

In the above-mentioned embodiments, the radiators 33 are provided at the both sides of the refrigerant vessel 32; however, as shown in FIGS. 26A and 26B, a looped (for example, annular) radiator 33 may be provided on an entire circumference of the refrigerant vessel 32. In this case, preferably, the vapor outflow passage in the refrigerant vessel 32 is open at the entire circumference of the refrigerant vessel 32. The radiators 33 have a water-cooling structure with the water jackets 40; however, they may have an air-cooling structure in which refrigerant vapor is cooled by outside air.

Eighth Embodiment

Next, an eighth embodiment of the invention is explained referring to FIGS. 27 to 35, in which the same parts as those in the sixth embodiment are designated with the same reference numerals. A boiling cooler 30*b* in this embodiment has a refrigerant flow control member described below in addition to the refrigerant vessel 32 and the radiators 33 for cooling vapor of refrigerant boiled upon receiving heat from the heat element 31.

Figure 27:
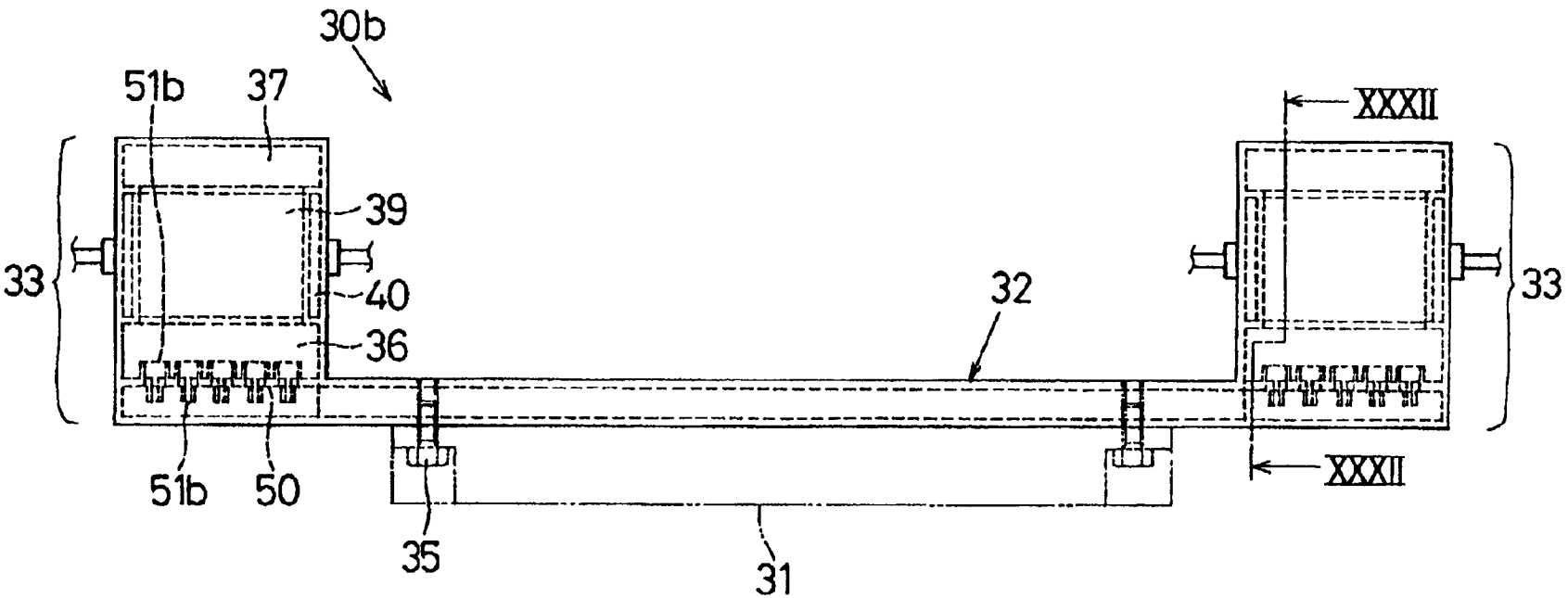
FIG. 27 is a front view showing a boiling cooler according to an eight embodiment of the invention.
Figure 28:
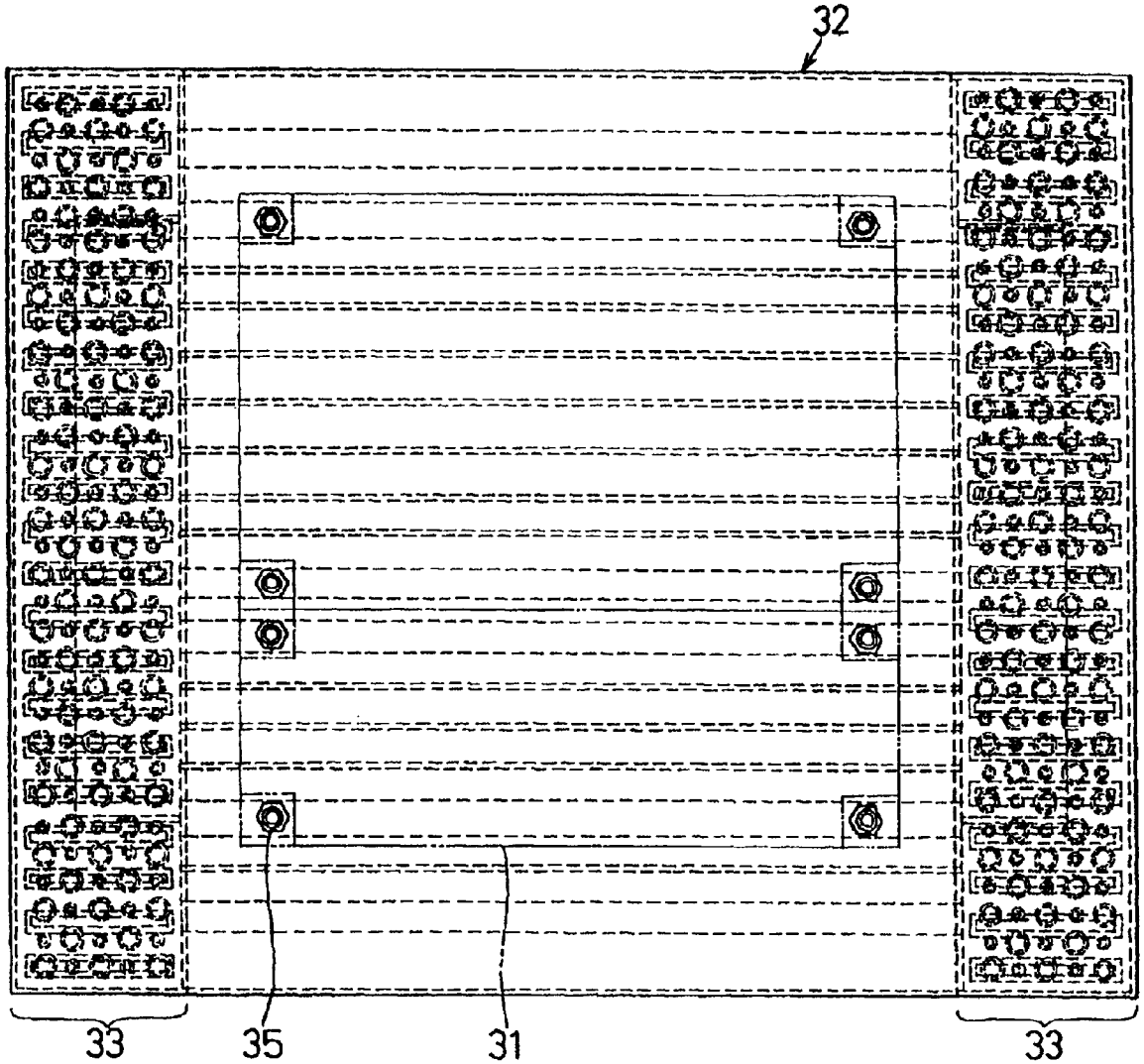
FIG. 28 is a bottom view showing the boiling cooler of FIG. 27.
Figure 29:
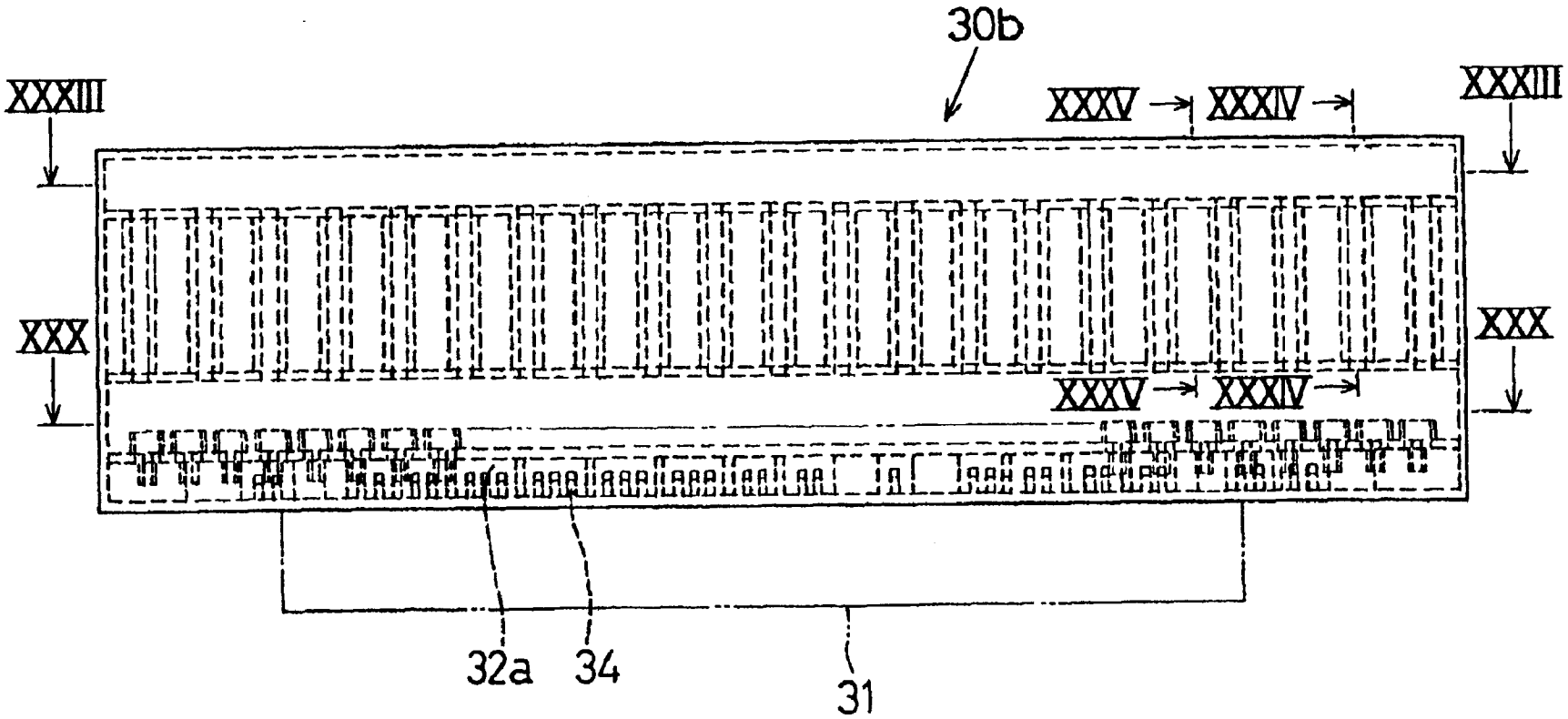
FIG. 29 is a side view showing the boiling cooler of FIG. 27.
Figure 30:
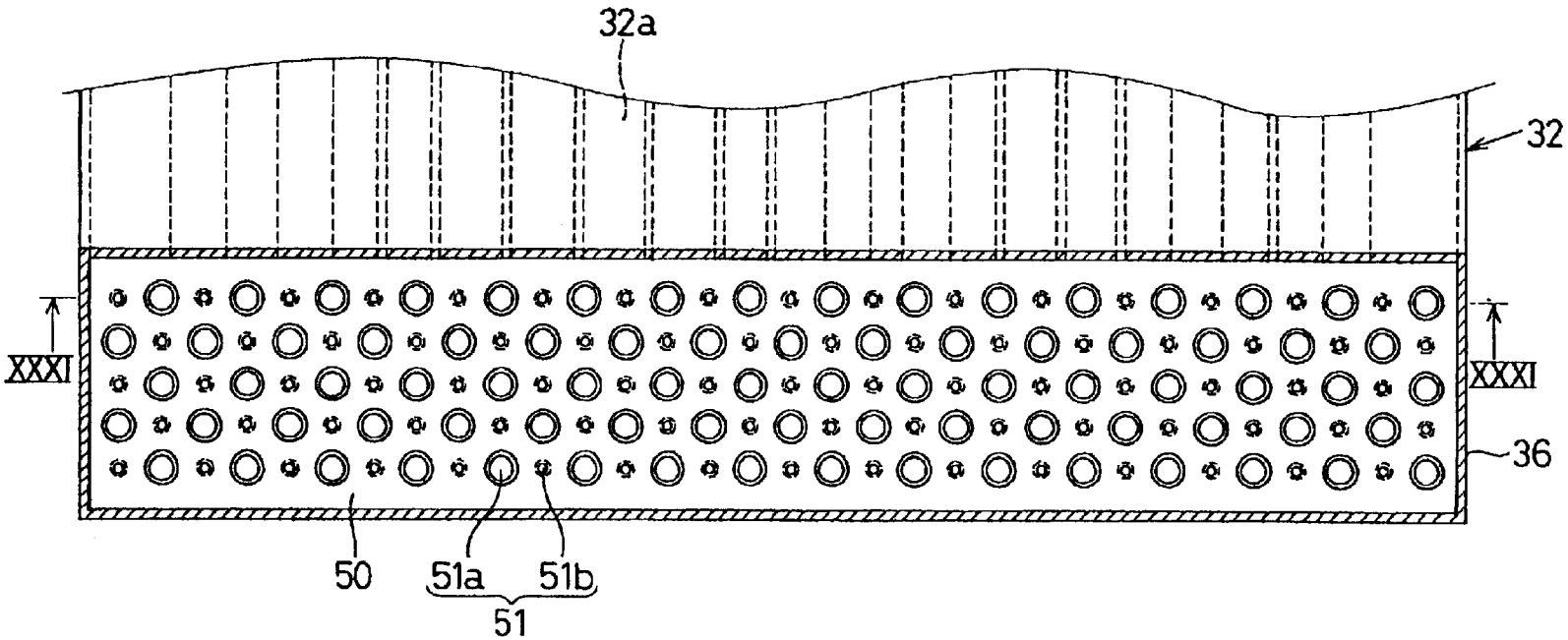
FIG. 30 is a cross-sectional view taken along line XXX—XXX in FIG. 29.
Figure 31:
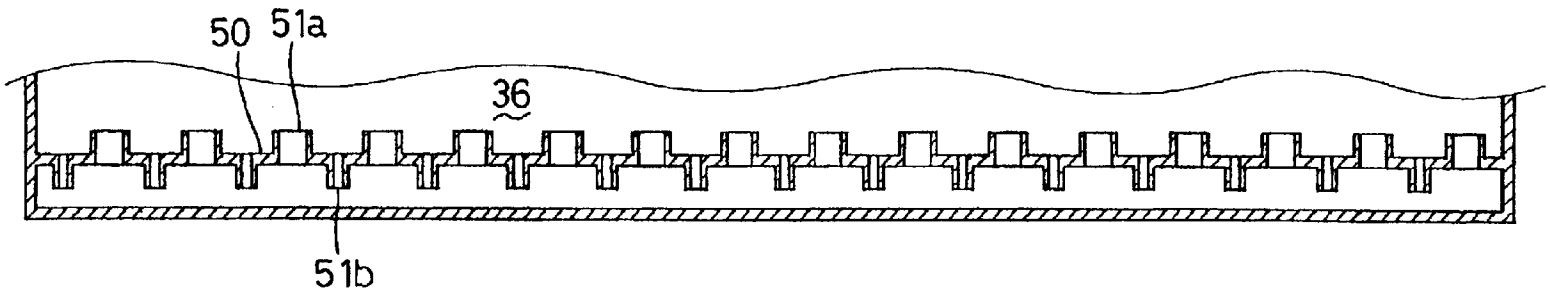
FIG. 31 is a cross-sectional view taken along line XXXI—XXXI in FIG. 30.
Figure 32:
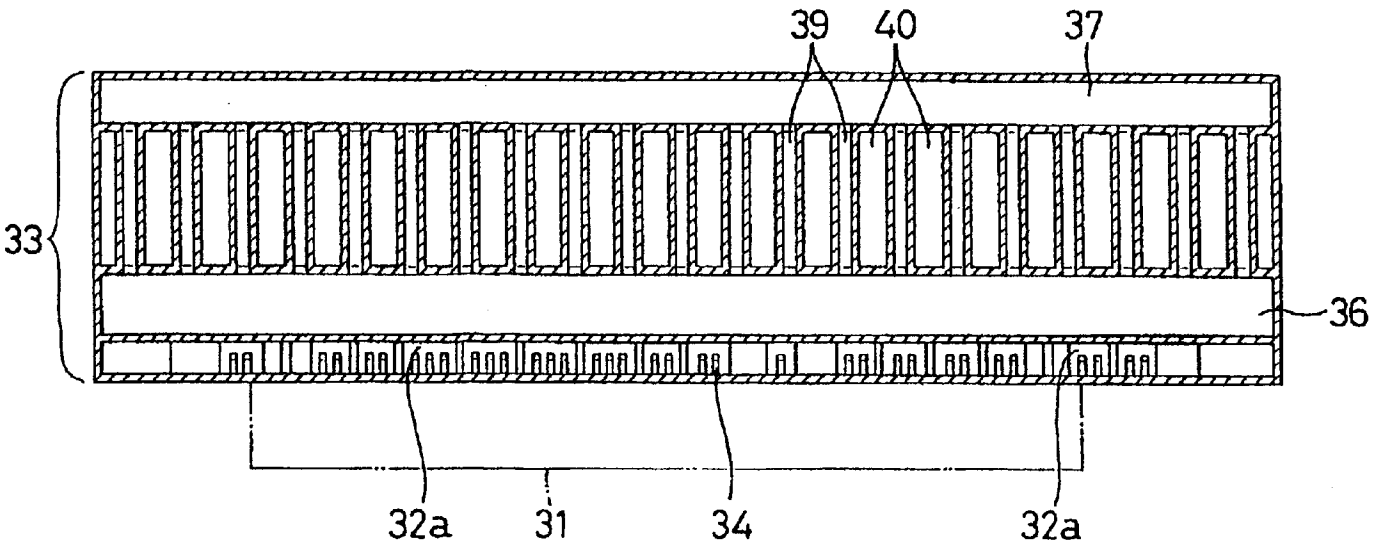
FIG. 32 is a cross-sectional view taken along line XXXII—XXXII in FIG. 27.
Figure 33:
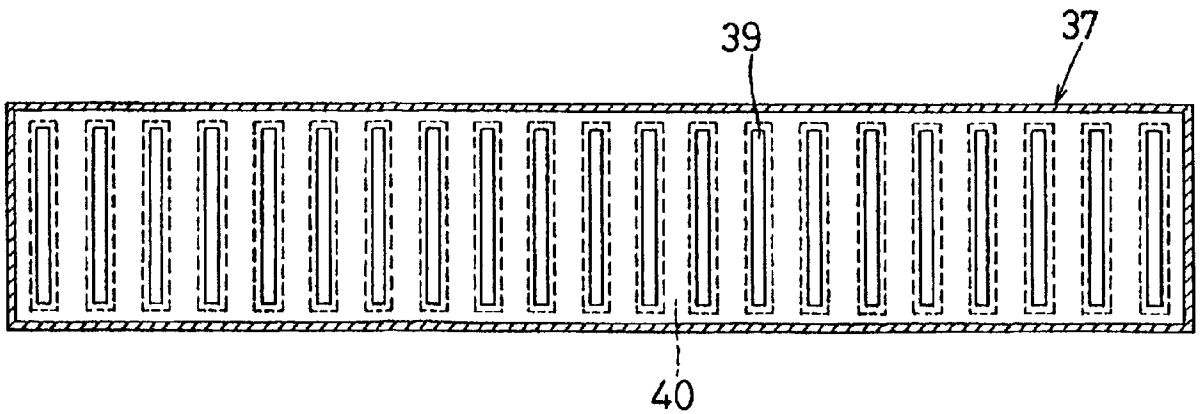
FIG. 33 is a cross-sectional view taken along line XXXIII—XXXIII in FIG. 29.

The refrigerant flow control member is, as shown in FIG. 27, provided inside the lower tank 36, and is, as shown in FIG. 30, composed of a control plate 50 generally horizontally disposed in the lower tank 36 and communication ports 51 (51*a*, 51*b*) penetrating the control plate 50. As shown in FIG. 31, the inside of the lower tank 36 is divided by the control plate 50 into an upper space (space at the side of the radiator 33) and a lower space (space at the side of the refrigerant vessel 32), and the upper space and the lower space communicate with each other through the communication ports 51 refrigerant vapor and condensate pass through.

Figure 34:
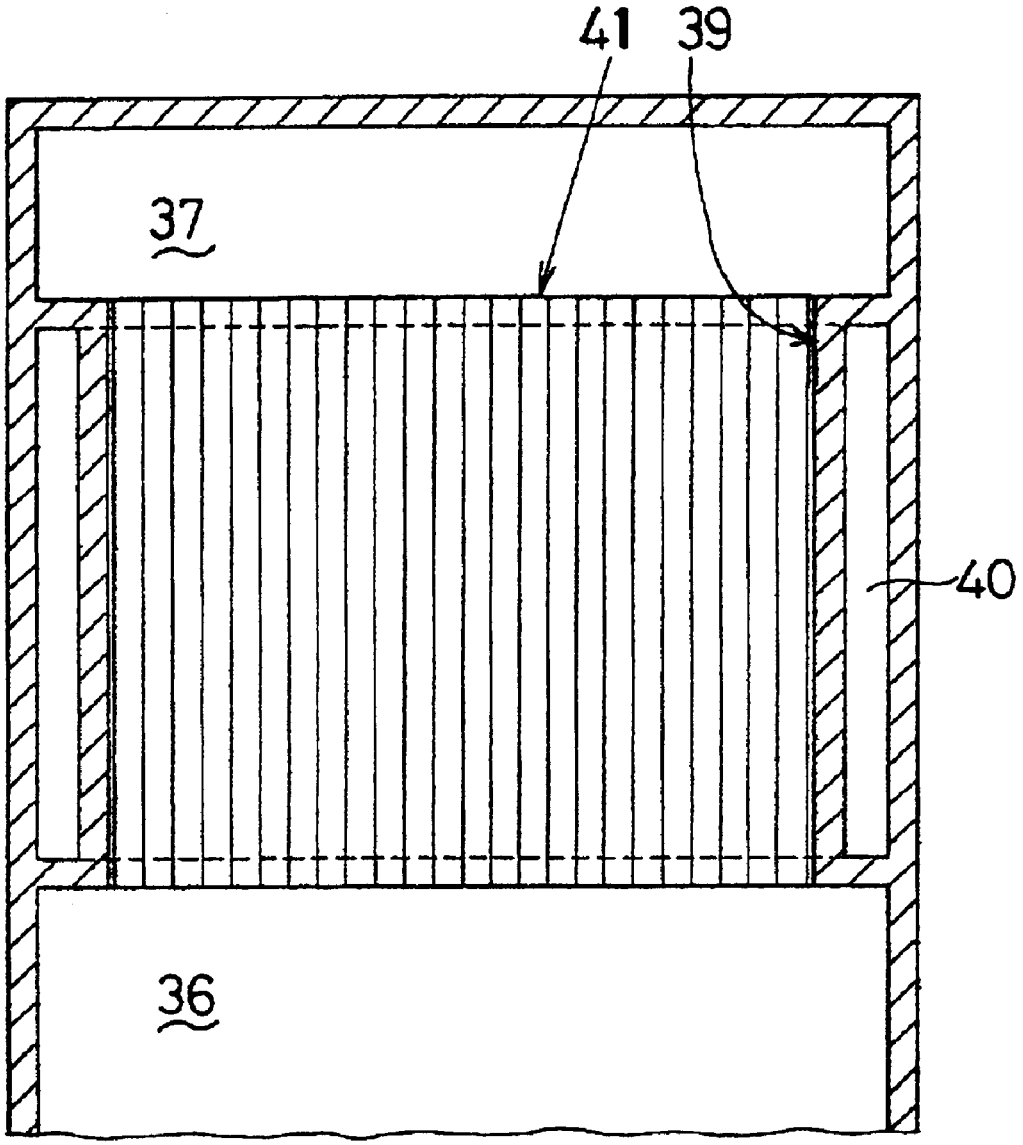
FIG. 34 is a cross-sectional view taken along line XXXIV—XXXIV in FIG. 29.
Figure 35:
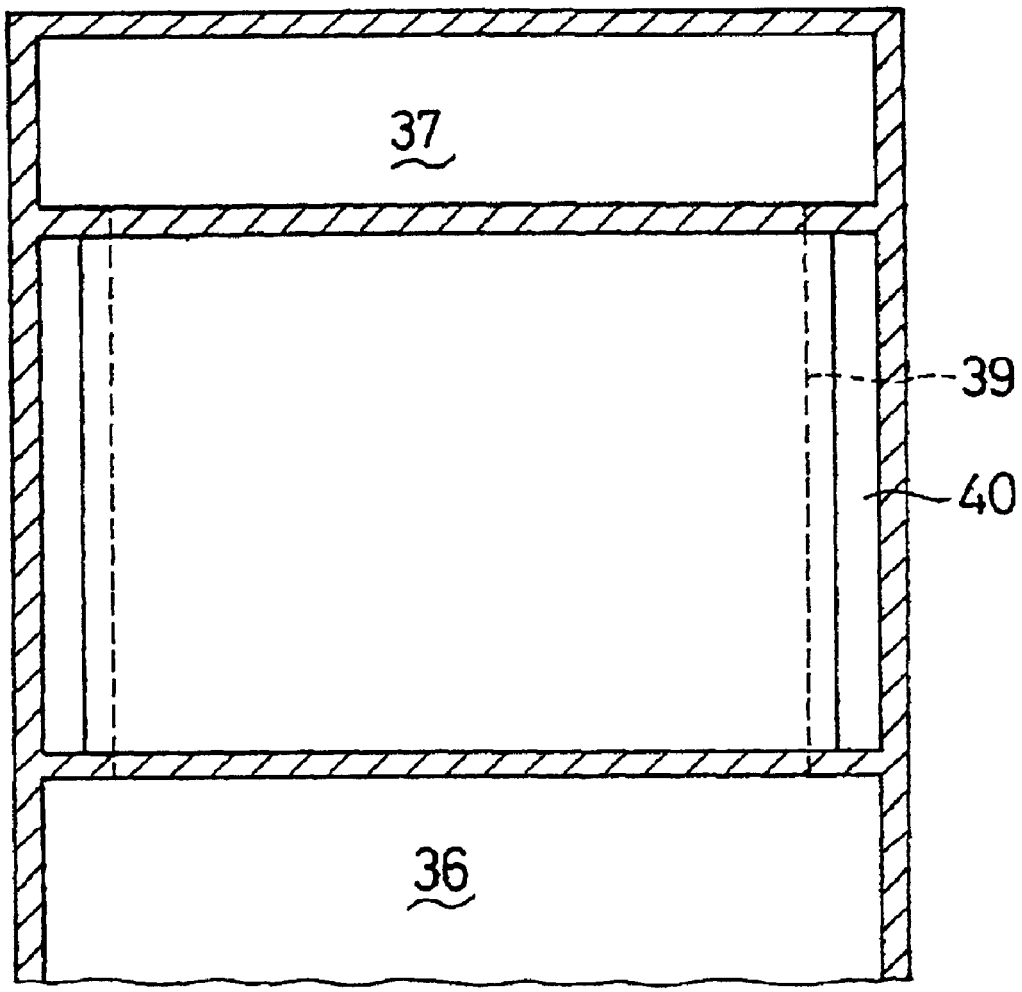
FIG. 35 is a cross-sectional view taken along line XXXV—XXXV in FIG. 29.

The communication ports 51 are composed of first communication ports 51*a* cylindrically projecting from the upper surface of the control plate 50 into the upper space and opening at a higher position than the upper surface of the control plate 50, and second communication ports 51*b* cylindrically projecting from the lower surface of the control plate 50 into the lower space and opening at a lower position than the lower surface of the control plate 50. The first communication ports 51*a* and the second communication ports 51*b* are, as shown in FIG. 30, alternately provided at a given pitch in the lateral direction and in the longitudinal direction of the control plate 50. Each first communication port 51*a* has an opening area larger than that of each second communication port 51*b*. The other features are substantially the same as those in the sixth embodiment. Incidentally, FIG. 34 shows arrangement of an inner fin 41 in a radiation passage 39, which is different from that shown in FIG. 16 in the sixth embodiment; however, the inner fin 41 may be arranged in the radiation passage 39 as shown in FIG. 16 in this embodiment.

Next, an operation in this embodiment is explained.

Liquid refrigerant stored in the refrigerant vessel 32 is boiled by heat from the heating element 31 to produce refrigerant vapor, and refrigerant vapor flows into the lower space of the lower tank 36 through the passage portions 32*a*. In the lower space, it is difficult for refrigerant vapor to flow into the second communication ports 51*b* because the second communication ports 51*b* cylindrically project downward from the lower surface of the control plate 50. Therefore, refrigerant vapor mainly flows into the cylindrical first communication ports 51*a*, and enters the upper space of the lower tank 36. After that, refrigerant vapor flows in the radiation passages 39 in the heat exchange part in which it is cooled by cooling water flowing in the water jackets 40 to be condensed and liquefied on the surface of the inner fins 41 and on the inner walls of the radiation passages 39.

Most liquefied condensate drops onto the upper surface of the control plate 50 from the radiation passages 39, and a part of the condensate drops directly into the communication ports 51 (mainly the second communication ports 51*b* because refrigerant vapor is blowing up from the first communication ports 51*a* in this case) to be dropped into the lower space of the lower tank 36. The condensate dropped onto the upper surface of the control plate 50 is finally conducted into the lower space of the lower tank 36 through the second communication ports 51*b*, and returns to the boiling portion in the refrigerant vessel 32.

As mentioned above, the refrigerant flow control member in this embodiment has the first communication ports 51*a* cylindrically projecting from the control plate 50 into the upper space to open at the position higher than the upper surface of the control plate 50, and the second communication ports 51*b* cylindrically projection from the control plate 50 into the lower space to open at the position lower than the lower surface of the control plate 50. In addition, the opening area of each second communication port 51*b* is smaller than that of each first communication port 51*a*. Therefore, when refrigerant vapor passes through the first or second communication ports 51*a*, 51*b* to enter the upper space in the lower tank 36, it mainly flows into the first communication ports 51*a* to enter the lower space because the flow resistance of the second communication ports 51*b* is large in comparison with that of the first communication ports 51*a*.

Also, condensate liquefied in the heat exchange part drops onto the upper surface of the control plate 50, and flows into the lower space of the lower tank 36 not through the first communication ports 51*a* opening at the position higher than the upper surface of the control plate 50, but through the second communication ports 51*b*.

As a result, refrigerant vapor flow and condensate flow can be separated from each other when they passes through the communication ports 51 of the control plate 50, so that interference between refrigerant vapor and condensate can be suppressed and refrigerant can circulate efficiently. Further, because the first communication ports 51*a* in which refrigerant vapor is liable to flow have the opening area larger than that of the second communication ports 51*b* in which condensate is liable to flow, the refrigerant vapor flow and the condensate flow can be controlled more efficiently. The other advantages are substantially the same as those in the above-mentioned embodiments.

Ninth Embodiment

Figure 36:
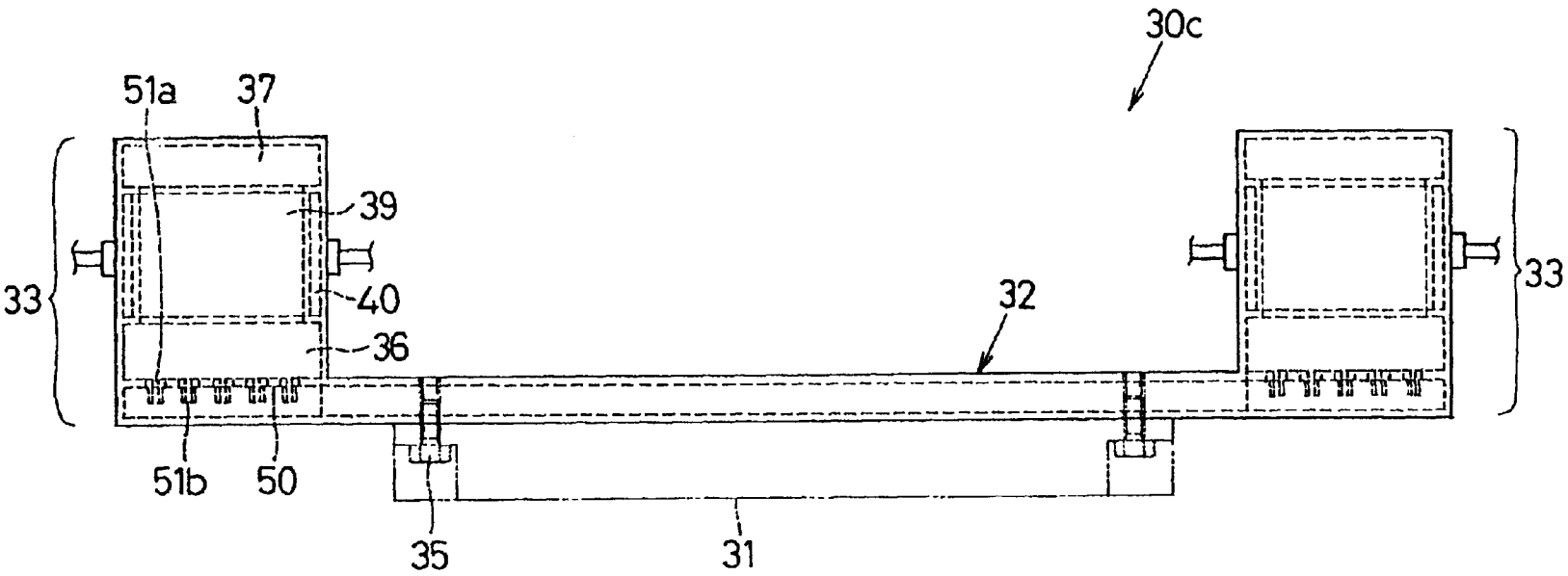
FIG. 36 is a front view showing a boiling cooler according to a ninth embodiment of the invention.
Figure 37:
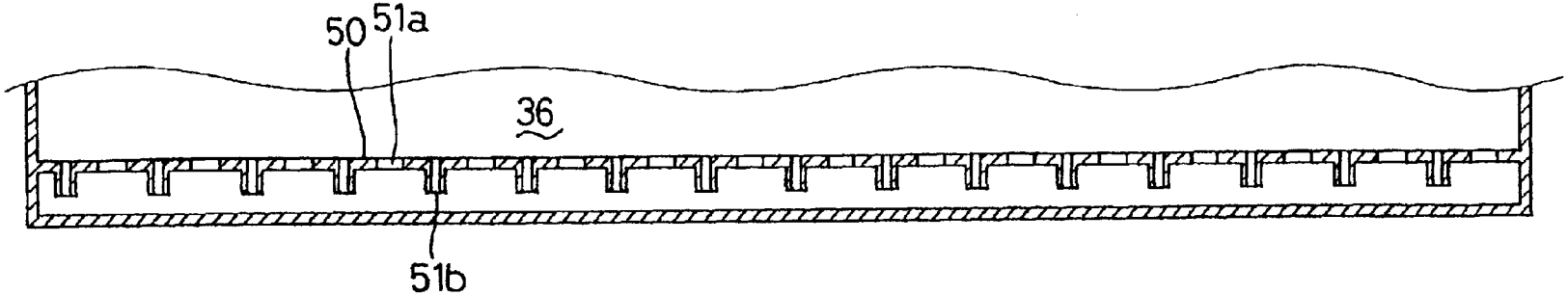
FIG. 37 is a cross-sectional view showing a refrigerant flow control member of the boiling cooler in the ninth embodiment.

FIG. 36 is a front view showing a boiling cooler 30*c* according to a ninth embodiment of the invention. The boiling cooler 30*c* is different from the boiling cooler 30*b* shown in FIG. 27 in the structure of the refrigerant flow control member. In this embodiment, as shown in FIG. 37, the first communication ports 51*a* are open on the upper surface of the control plate 50, and the second communication ports 51*b* cylindrically protrude from the lower surface control plate 50 downward and open at a position lower than that of the lower surface of the control plate 50.

According to this constitution, similarly to the eighth embodiment, refrigerant vapor produced in the refrigerant vessel 32 is liable to pass through the first communication ports 51*a*, having smaller resistance than that of the second communication ports 51*b*, so as to enter the upper space of the lower tank 36. Therefore, condensate is liable to flow in the second communication port 51*b* while avoiding the first communication ports 51*a* from which refrigerant vapor is blowing up. In consequence, refrigerant vapor flow and condensate flow can be separated from each other and refrigerant can circulate efficiently.

Tenth Embodiment

Figure 38:
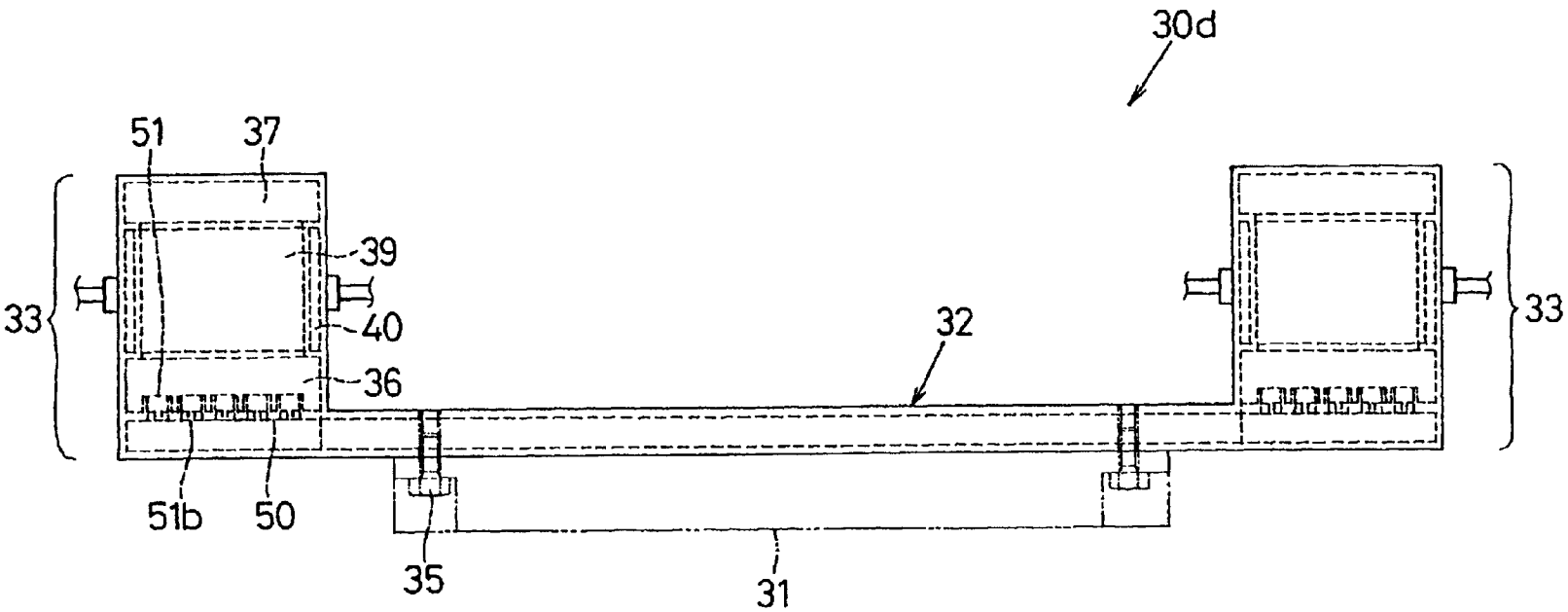
FIG. 38 is a front view showing a boiling cooler according to a tenth embodiment of the invention.
Figure 39:
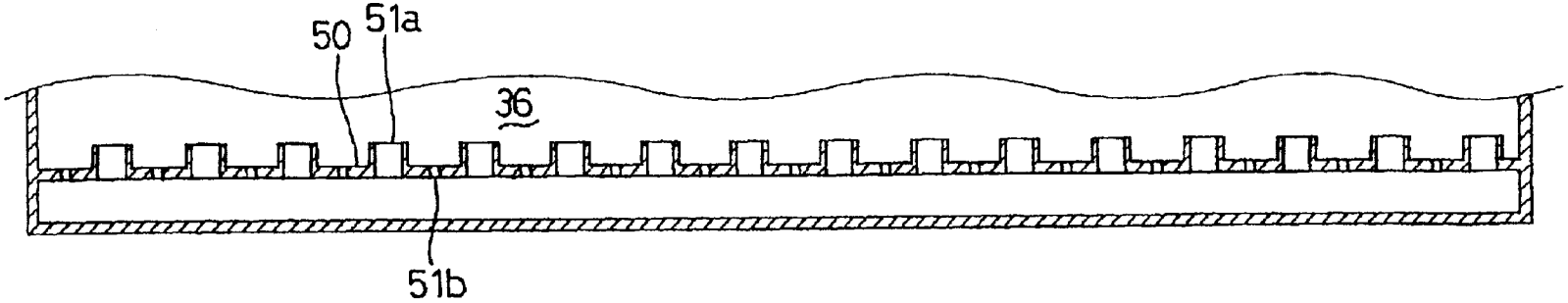
FIG. 39 is a cross-sectional view showing a refrigerant flow control member of the boiling cooler in the tenth embodiment.

FIG. 38 is a front view showing a boiling cooler 30*d* according to a tenth embodiment of the invention. The refrigerant flow control member in this embodiment has, as shown in FIG. 39, first communication ports 51*a* that cylindrically project from the upper surface of the control plate 50 to open at a position higher than the upper surface of the control plate 50, and second communication ports 51*b* that are open on the lower surface of the control plate 50.

According to this constitution, like the eighth embodiment, condensate liquefied in the radiator drops on the surface of the control plate 50, and then flows into the second communication ports 51*b* to be conducted into the lower space of the lower tank 36. The condensate does not flow into the first communication ports 51*a* that open at the higher position than the surface of the control plate 50. Therefore, refrigerant vapor produced in the refrigerant vessel 32 can mainly flow into the first communication ports 51*a* to enter the upper space at the radiation side. In consequence, refrigerant vapor flow and condensate flow can be separated from each other without interference therebetween, and refrigerant can circulate efficiently.

The boiling coolers described in the above-mentioned embodiments are not used only for vehicles, but may be used for any transportation means such as ships (especially small-size ship capable of being swung largely) and helicopters. Otherwise, it may be used on a slope.

While the present invention has been shown and described with reference to the foregoing preferred embodiments, it will be apparent to those skilled in the art that changes in form and detail may be made therein without departing from the scope of the invention as defined in the appended claims.

What is claimed is:

1. A boiling cooler for cooling a heating element, the boiling cooler comprising:

a refrigerant vessel storing liquid refrigerant therein, the refrigerant vessel having a boiling portion where the liquid refrigerant boils to produce refrigerant vapor, and defining therein a vapor outflow passage through which the refrigerant vapor flows toward first and second outlet portions provided at opposite ends of the vapor outflow passage;

a first radiator disposed at a first end side of the refrigerant vessel to communicate with the first outlet portion of the vapor outflow passage; and a second radiator disposed at a second end side of the refrigerant vessel, opposite to the first side, to communicate with the second outlet portion of the vapor outflow passage, wherein;

each of the first and second radiators includes a heat exchange part having a vapor passage in which the refrigerant vapor from the vapor outflow passage flows to perform heat exchange with liquid coolant, and a tank defining a refrigerant chamber that communicates with the refrigerant vessel and stores therein the liquid refrigerant with a liquid surface;

the vapor passage of the heat exchange part is provided above the liquid surface stored in the tank; and the vapor outflow passage is provided in the refrigerant vessel to extend in a direction crossing with a vertical direction.

2. The boiling cooler according to claim 1, wherein the heat exchange part further comprises a coolant passage in which the liquid coolant flows to perform the heat exchange with the refrigerant vapor, the coolant passage adjoining the vapor passage.

3. The boiling cooler according to claim 1, wherein the tank is separated from the coolant passage by a boundary wall that has a convexo-concave shape.

4. The boiling cooler according to claim 3, wherein the boundary wall has a plurality of protruding portions protruding into the coolant passage and having heights that have a maximum value generally at a central portion of the tank in a horizontal direction and decrease toward both sides of the tank in the horizontal direction.

5. The boiling cooler according to claim 3, wherein:

the boundary wall has first and second protruding portions protruding into the coolant passage; and an inner fin is disposed in the coolant passage between outer walls of the first and second protruding portions to increase a radiation area for radiating heat.

6. The boiling cooler according to claim 2, further comprising a coolant circuit composed of a cooling radiator and a pump for circulating the coolant therein, wherein:

the coolant passage is connected to the liquid coolant circuit; and the liquid coolant is circulated in the coolant passage by an operation of the pump.

7. The boiling cooler according to claim 1, wherein the vapor outflow passage has an upper wall that is inclined so that the refrigerant vapor flows toward at least one of the first and second outlet portions upward along the upper wall.

8. The boiling cooler according to claim 7, wherein the first radiator has a looped shape and surrounds an entire circumference of the refrigerant vessel where the vapor outflow passage is open to form the first outlet portion through which the first radiator and the vapor outflow passage communicate with each other.

9. The boiling cooler according to claim 7, wherein:

the refrigerant vessel has a liquid return passage into which the condensate flows from the heat exchange part, the liquid return passage communicating with the vapor outflow passage through the tank of the first radiator.

10. The boiling cooler according to claim 1, wherein the boiling cooler is used for a vehicle.

11. The boiling cooler according to claim 1, wherein:

the tank communicates with the vapor outflow passage through the first outlet portion, and the heat exchange part disposed above the lower tank;

in the heat exchange part, the refrigerant vapor is liquefied as condensate by the heat exchange with the liquid coolant;

the refrigerant vessel has a liquid return passage into which the condensate flows from the heat exchange part, the liquid return passage communicating with the vapor outflow passage through the lower tank of the first radiator.

12. The boiling cooler according to claim 1, further comprising:

a refrigerant flow control member disposed between the heat exchange part and the refrigerant vessel, and having a control plate that is disposed approximately horizontally to divide a radiator side space from a refrigerant vessel side space and has a plurality of communication ports through which the radiator side space communicates with the refrigerant vessel side space, the refrigerant flow control member being for controlling a flow of the refrigerant vapor from the refrigerant vessel side space to the radiator side space, and a flow of the condensate from the radiator side space to the refrigerant vessel side space.

13. The boiling cooler according to claim 12, wherein:

the plurality of communication ports are composed of a plurality of first communication ports and a plurality of second communication ports;

the plurality of first communication ports cylindrically protrude from an upper surface of the control plate into the radiator side space and are open at a position higher than the upper surface of the control plate in a vertical direction; and the plurality of second communication ports cylindrically protrude from a lower surface of the control plate into the refrigerant vessel side space and are open at a position lower than the lower surface of the control plate in the vertical direction.

14. The boiling cooler according to claim 13, wherein each of the plurality of first communication ports has an opening area larger than an opening area of each of the plurality of second communication ports.

15. The boiling cooler according to claim 12, wherein:

the plurality of communication ports are composed of a plurality of first communication ports and a plurality of second communication ports;

the plurality of first communication ports are open on an upper surface of the control plate without protruding from the upper surface; and the plurality of second communication ports cylindrically protrude from a lower surface of the control plate into the refrigerant vessel side space and are open at a position lower than the lower surface of the control plate in a vertical direction.

16. The boiling cooler according to claim 15, wherein each of the plurality of first communication ports has an opening area larger than an opening area of each of the plurality of second communication ports.

17. The boiling cooler according to claim 12, wherein:

the plurality of communication ports are composed of a plurality of first communication ports and a plurality of second communication ports;

the plurality of first communication ports cylindrically protrude from an upper surface of the control plate into the radiator side space and are open at a position higher than the upper surface of the control plate in a vertical direction; and the plurality of second communication ports are open on a lower surface of the control plate without protruding from the lower surface.

18. The boiling cooler according to claim 17, wherein each of the plurality of first communication ports has an opening area larger than an opening area of each of the plurality of second communication ports.

19. The boiling cooler according to claim 12, wherein the plurality of communication ports are arranged on the control plate at an approximately constant pitch.

20. A cooling system for cooling a heating element, comprising:

a boiling cooler comprising:

a refrigerant vessel storing liquid refrigerant therein, the refrigerant vessel having a boiling portion where the liquid refrigerant boils to produce refrigerant vapor, and defining therein a vapor outflow passage through which the refrigerant vapor flows toward first and second outlet portions provided at opposite ends of the vapor outflow passage;

a first radiator disposed at a first end side of the refrigerant vessel to communicate with the first outlet portion of the vapor outflow passage; and a second radiator disposed at a second end side of the refrigerant vessel, opposite to the first side, to communicate with the second outlet portion of the vapor outflow passage, wherein:

each of the first and second radiators includes a heat exchange part having a vapor passage in which the refrigerant vapor from the vapor outflow passage flows to perform heat exchange with liquid coolant, and a tank defining a refrigerant chamber that communicates with the refrigerant vessel and stores therein the liquid refrigerant with a liquid surface;

the vapor passage of the heat exchange part is provided above the liquid surface stored in the tank; and the vapor outflow passage is provided in the refrigerant vessel to extend in a direction crossing with a vertical direction;

a cooling radiator connected to the boiling cooler, for cooling the liquid coolant; and a motor connected to the boiling cooler in series for supplying the liquid coolant from the radiator to the boiling cooler.

21. The cooling system according to claim 20, wherein the boiling cooler, the first and second radiators, and the motor constitute a liquid coolant circuit in which the coolant circulates.

22. The cooling system according to claim 20, wherein the first radiator cools the liquid coolant by heat exchange with air flowing outside the radiator.

23. The cooling system according to claim 20, further comprising a pipe connecting the radiator and a coolant passage defined in the boiling cooler in which the coolant flows.

24. The boiling cooler according to claim 1, wherein:

the heat exchange part further comprises a coolant passage in which liquid coolant flows to perform heat exchange with refrigerant vapor in the vapor passage; and the coolant passage is provided to be separated from outside air outside the heat exchange part.

25. The boiling cooler according to claim 1, wherein the vapor outflow passage is provided to extend approximately horizontally.

* * * * *